US005967049A

United States Patent [19]

Seymour et al.

[11] Patent Number: 5,967,049

[45] Date of Patent: Oct. 19, 1999

[54] INK KEY CONTROL IN A PRINTING PRESS INCLUDING LATERAL INK SPREAD, INK SATURATION, AND BACK-FLOW COMPENSATION

[75] Inventors: John C. Seymour, Jefferson; Chia-Lin Chu, Brookfield, both of Wis.

[73] Assignee: Quad/Tech, Inc., Sussex, Wis.

[21] Appl. No.: 08/997,288

[22] Filed: Dec. 23, 1997

Related U.S. Application Data

[60] Provisional application No. 60/045,570, May 5, 1997.

[51] Int. Cl.[6] ..... B41F 31/14

[52] U.S. Cl. ..... 101/484; 101/365

[58] Field of Search ..... 101/365, 486, 101/170, 483, 484, 485, 352.06, 350.2, 350.1, 350.3; 250/559.1, 559.02, 559.36, 559.04, 559.39; 356/444, 380; 358/296, 406, 456, 465, 501

[56] References Cited

U.S. PATENT DOCUMENTS

| | | | |
|---|---|---|---|
| 3,958,509 | 5/1976 | Murray et al. | 101/426 |
| 4,008,664 | 2/1977 | Crum et al. | 101/365 |
| 4,180,741 | 12/1979 | Palmatier et al. | 250/559 |
| 4,187,435 | 2/1980 | Palmatier et al. | 250/559 |
| 4,210,818 | 7/1980 | Green et al. | 250/559 |
| 4,233,663 | 11/1980 | Sugawara et al. | 364/515 |
| 4,512,662 | 4/1985 | Tobias | 356/380 |
| 4,553,478 | 11/1985 | Greiner et al. | 101/426 |
| 4,586,148 | 4/1986 | Rehder et al. | 364/550 |
| 4,655,135 | 4/1987 | Brovman | 101/426 |
| 4,660,159 | 4/1987 | Ott | 364/526 |
| 5,014,618 | 5/1991 | Zingher et al. | 101/365 |
| 5,052,298 | 10/1991 | Runyan et al. | 101/365 |
| 5,070,784 | 12/1991 | Nishida et al. | 101/365 |
| 5,129,320 | 7/1992 | Fadner | 101/365 |
| 5,138,944 | 8/1992 | Rancourt et al. | 101/365 |
| 5,170,711 | 12/1992 | Maier et al. | 101/365 |
| 5,224,421 | 7/1993 | Doherty | 101/211 |
| 5,524,542 | 6/1996 | Toyama | 101/485 |

FOREIGN PATENT DOCUMENTS

WO 94/25278 11/1994 WIPO .

OTHER PUBLICATIONS

"An Experimental Testing of a Theory of Ink Distribution", C.C. Mill, Advances on Printing Technology, vol. 1 (1961), pp. 183–197.

"About Measurement and Computation of Ink Transfer in Roller Inking Units of Printing Presses", K.R. Scheuter and H. Rech, TAGA Proceedings (1990).

*Primary Examiner*—J. Reed Fisher

*Attorney, Agent, or Firm*—Michael Best & Friedrich LLP

[57] ABSTRACT

A method is disclosed for correction of the effects of ink back-flow and lateral flow in the inking system of a web-offset printing press. A plate coverage equation dependent on plate coverage is used to compensate for ink back-flow into the ink reservoir. An ink key distribution function is utilized to correct for the blurring effects of lateral ink spread caused by the action of vibrator rollers. A correction is also made for the ink saturation effect. The method is applicable to an ink key preset system.

35 Claims, 21 Drawing Sheets

$t_1 = K(t_0+t_2)$
$t_2 = K(t_1+t_4)$
$t_3 = (1-K)(t_1+t_4)$
$t_3 = (1-K)(t_3+t_5)$
$t_5 = K(t_{10}+t_8)$
$t_6 = K(t_3+t_5)$
$t_7 = K(t_6+t_{13})$
$t_8 = K(t_7+t_{12})$
$t_9 = (1-K)(t_{10}+t_8)$
$t_{10} = c(1-K)(t_9+t_{25})+(1-c)t_9$
$t_{11} = (1-K)(t_7+t_{12})$
$t_{12} = c(1-K)(t_{11}+t_{26})+(1-c)t_{11}$
$t_{13} = (1-K)(t_{14}+t_{16})$
$t_{14} = (1-K)(t_6+t_{13})$
$t_{15} = K(t_{14}+t_{16})$
$t_{16} = K(t_{15}+t_{17})$
$t_{17} = (1-K)(t_{18}+t_{20})$
$t_{18} = (1-K)(t_{15}+t_{17})$
$t_{19} = K(t_{18}+t_{20})$
$t_{20} = K(t_{19}+t_{21})$
$t_{21} = c(1-K)(t_{22}+t_{23})+(1-c)t_{22}$
$t_{22} = (1-K)(t_{19}+t_{21})$
$t_{23} = K(t_{11}+t_{26})$
$t_{24} = K(t_{22}+t_{23})$
$t_{25} = K(t_{24}+t_{28})$
$t_{26} = K(t_9+t_{25})$
$t_{27} = (1-K)(t_{24}+t_{28})$
$t_{28} = (1-K)t_{27}$
$t_{29} = Kt_{27}$
$t_0 - t_{-1} = t_{29}$

| | 10% Coverage | 30% Coverage | 50% Coverage | 70% Coverage | 90% Coverage | 100% Coverage |
|---|---|---|---|---|---|---|
| $t_1$ | 0.972 | 0.929 | 0.900 | 0.878 | 0.861 | 0.854 |
| $t_2$ | 0.943 | 0.859 | 0.799 | 0.756 | 0.722 | 0.708 |
| $t_3$ | 0.943 | 0.859 | 0.799 | 0.756 | 0.722 | 0.708 |
| $t_4$ | 0.915 | 0.788 | 0.699 | 0.633 | 0.583 | 0.562 |
| $t_5$ | 0.886 | 0.717 | 0.599 | 0.511 | 0.444 | 0.417 |
| $t_6$ | 0.915 | 0.788 | 0.699 | 0.633 | 0.583 | 0.562 |
| $t_7$ | 0.911 | 0.778 | 0.685 | 0.616 | 0.564 | 0.542 |
| $t_8$ | 0.902 | 0.754 | 0.648 | 0.568 | 0.506 | 0.479 |
| $t_9$ | 0.886 | 0.717 | 0.599 | 0.511 | 0.444 | 0.417 |
| $t_{10}$ | 0.870 | 0.680 | 0.549 | 0.455 | 0.383 | 0.354 |
| $t_{11}$ | 0.902 | 0.754 | 0.648 | 0.568 | 0.506 | 0.479 |
| $t_{12}$ | 0.893 | 0.730 | 0.611 | 0.520 | 0.448 | 0.417 |
| $t_{13}$ | 0.907 | 0.768 | 0.671 | 0.599 | 0.544 | 0.521 |
| $t_{14}$ | 0.911 | 0.778 | 0.685 | 0.616 | 0.564 | 0.542 |
| $t_{15}$ | 0.907 | 0.768 | 0.671 | 0.599 | 0.544 | 0.521 |
| $t_{16}$ | 0.903 | 0.759 | 0.657 | 0.582 | 0.524 | 0.500 |
| $t_{17}$ | 0.899 | 0.749 | 0.644 | 0.565 | 0.505 | 0.749 |
| $t_{18}$ | 0.903 | 0.759 | 0.657 | 0.582 | 0.524 | 0.500 |
| $t_{19}$ | 0.899 | 0.749 | 0.644 | 0.565 | 0.505 | 0.479 |
| $t_{20}$ | 0.895 | 0.739 | 0.630 | 0.548 | 0.485 | 0.458 |
| $t_{21}$ | 0.891 | 0.729 | 0.616 | 0.531 | 0.465 | 0.437 |
| $t_{22}$ | 0.895 | 0.739 | 0.630 | 0.548 | 0.485 | 0.458 |
| $t_{23}$ | 0.815 | 0.674 | 0.574 | 0.499 | 0.441 | 0.417 |
| $t_{24}$ | 0.855 | 0.707 | 0.602 | 0.524 | 0.463 | 0.437 |
| $t_{25}$ | 0.570 | 0.471 | 0.401 | 0.349 | 0.309 | 0.292 |
| $t_{26}$ | 0.728 | 0.594 | 0.500 | 0.430 | 0.377 | 0.354 |
| $t_{27}$ | 0.570 | 0.471 | 0.401 | 0.349 | 0.309 | 0.292 |
| $t_{28}$ | 0.285 | 0.236 | 0.201 | 0.175 | 0.154 | 0.146 |
| $t_{29}$ | 0.285 | 0.236 | 0.201 | 0.175 | 0.154 | 0.146 |

FIG. 14

| | |
|---|---|
| −6.5 | 0. |
| −6.25 | 0. |
| −6. | 0. |
| −5.75 | 0.0017 |
| −5.5 | 0.0052 |
| −5.25 | 0.0071 |
| −5. | 0.0107 |
| −4.75 | 0.0125 |
| −4.5 | 0.0081 |
| −4.25 | 0.0086 |
| −4 | 0.0105 |
| −3.75 | 0.0112 |
| −3.5 | 0.0109 |
| −3.25 | 0.0161 |
| −3. | 0.0217 |
| −2.75 | 0.0305 |
| −2.5 | 0.0376 |
| −2.25 | 0.0414 |
| −2 | 0.0577 |
| −1.75 | 0.0768 |
| −1.5 | 0.1180 |
| −1.25 | 0.1967 |

| | |
|---|---|
| −1. | 0.3111 |
| −0.75 | 0.4260 |
| −0.5 | 0.5239 |
| −0.25 | 0.5849 |
| 0 | 0.5239 |
| 0.25 | 0.4260 |
| 0.5 | 0.3111 |

| | |
|---|---|
| 0.75 | 0.1967 |
| 1. | 0.1180 |
| 1.25 | 0.0768 |
| 1.5 | 0.0577 |
| 1.75 | 0.0414 |
| 2. | 0.0376 |
| 2.25 | 0.0305 |
| 2.5 | 0.0217 |
| 2.75 | 0.0161 |
| 3. | 0.0109 |
| 3.25 | 0.0112 |
| 3.5 | 0.0105 |
| 3.75 | 0.0086 |
| 4. | 0.0081 |

FIG. 23

$$F_i = \frac{G\ R}{(0.46 + 0.54\ C_i)} \begin{bmatrix} 0.007 \\ 0.009 \\ 0.016 \\ 0.043 \\ 0.196 \\ 0.460 \\ 0.196 \\ 0.043 \\ 0.016 \\ 0.009 \\ 0.007 \end{bmatrix}^T \begin{bmatrix} I_{i-5}-b_{i-5} \\ I_{i-4}-b_{i-4} \\ I_{i-3}-b_{i-3} \\ I_{i-2}-b_{i-2} \\ I_{i-1}-b_{i-1} \\ I_i-b_i \\ I_{i+1}-b_{i+1} \\ I_{i+2}-b_{i+2} \\ I_{i+3}-b_{i+3} \\ I_{i+4}-b_{i+4} \\ I_{i+5}-b_{i+5} \end{bmatrix}$$

FIG. 24

VM=

$$
\begin{bmatrix}
.460 & .196 & .043 & .016 & .009 & .007 & .000 & .000 & .000 & \cdots & \cdots & & & \\
.196 & .460 & .196 & .043 & .016 & .009 & .007 & .000 & .000 & \cdots & \cdots & & & \\
.043 & .196 & .460 & .196 & .043 & .016 & .009 & .007 & .000 & \cdots & \cdots & & & \\
.016 & .043 & .196 & .460 & .196 & .043 & .016 & .009 & .007 & \cdots & \cdots & & & \\
.009 & .016 & .043 & .196 & .460 & .196 & .043 & .016 & .009 & .007 & \cdots & & & \\
.007 & .009 & .016 & .043 & .196 & .460 & .196 & .043 & .016 & .009 & .007 & & & \\
.000 & .007 & .009 & .016 & .043 & .196 & .460 & .196 & .043 & .016 & .009 & .007 & & \\
.000 & .000 & .007 & .009 & .016 & .043 & .196 & .460 & .196 & .043 & .009 & .009 & .007 & \\
\vdots & \vdots & & & & & & & & & & & & \\
\vdots & \vdots & & & & & & & & & & & & \\
\vdots & & & & & & .007 & .009 & .016 & .043 & .196 & .460 & .196 & .043 \\
\vdots & & & & & & .000 & .007 & .009 & .016 & .043 & .196 & .460 & .196 \\
.000 & \cdots & \cdots & & & & \cdots & .000 & .007 & .009 & .016 & .043 & .196 & .460
\end{bmatrix}
$$

FIG. 26

INK KEY CONTROL IN A PRINTING PRESS INCLUDING LATERAL INK SPREAD, INK SATURATION, AND BACK-FLOW COMPENSATION

RELATED APPLICATION

This application claims priority from prior filed provisional application Ser. No. 60/045,570, filed May 5, 1997.

FIELD OF THE INVENTION

The present invention relates generally to a system and method for controlling the ink feed in a web-offset printing press in order to achieve and maintain target values of color. More particularly, the invention relates to a system for controlling the ink feed and compensating for the lateral ink flow due to the movement of the vibrator rollers, the ink back-flow to the ink reservoir, the nonlinear relationship between ink thickness and ink density, and the inverse relationship between the plate coverage and the time constant required for achieving acceptable color quality.

BACKGROUND OF THE INVENTION

A web-offset printing press includes an inking assembly for each color of ink used in the printing process. Each inking assembly includes an ink reservoir as well as a blade disposed along the outer surface of an ink fountain roller. The amount of ink supplied to the roller train of the press and ultimately to a substrate such as paper is adjusted by changing the spacing between the edge of the blade and the outer surface of the ink fountain roller. The blade is divided into a plurality of blade segments, and the position of each blade segment relative to the ink fountain roller is independently adjustable by movement of an adjusting screw, or ink key, to thereby control the amount of ink fed to a corresponding vertical strip or zone of the substrate. Note that electronic equivalents of an ink key also exist, such as the equivalent disclosed in U.S. Pat. No. 5,129,320, issued Jul. 14, 1992 to Fadner. The term "ink key" is intended to include any device which controls the amount of ink fed to a corresponding vertical strip or zone of the substrate.

Typically, ink is also spread laterally from one vertical zone to adjacent vertical zones due to the movement of vibrator rollers, which oscillate in a lateral direction relative to the substrate.

The amount of ink on the ink fountain roller itself is also adjustable by changing the angle that the ink fountain roller rotates each stroke. Typically, this occurs by adjusting a ratchet assembly, as is known in the art.

In order to preset the initial positions of the ink keys, it is common for a printing press operator to examine printed copies or proofs of the image to be printed and to note the amount of color necessary in respective vertical zones of the image to be printed. Based on this visual examination as well as experience with the press, ink, and type of substrate (typically paper), the operator will preset the ink keys to approximate the settings that will be required once the press is running. As an example, low-tack yellow ink has a low pigment strength and requires a greater amount of ink to produce an image with a given optical density. As another example, uncoated paper requires more ink than does coated paper to achieve an image having a given optical density.

In addition to presetting the ink keys, once the press is running, it is common for a press operator to continually monitor the printed output and to make appropriate ink key adjustments in order to achieve appropriate quality control of the color of the printed image. For example, if the color in a zone is too weak, the operator adjusts the corresponding ink key to allow more ink flow to that zone; if the color is too strong, the corresponding ink key is adjusted to decrease the ink flow. During operation of the printing press, further color adjustments may be necessary to compensate for changing press conditions, or to account for the personal preferences of the customer.

The above-described visual inspection techniques used in connection with ink key presetting and color control are inaccurate, expensive, and time-consuming. Further, since the required image colors are often halftones combined with other colors, such techniques also require a high level of operator expertise.

Various other methods for presetting the ink keys are also known, which rely on a more exact measurement of plate coverage to achieve more accurate results than those obtained by visual estimation. Plate coverage is the ratio of the inked area to the total plate area, and provides a measure of the amount of ink required to print the desired image. By dividing the printing plate into zones corresponding to the ink keys, and determining the plate coverage of each zone, an initial ink key setting can be determined.

By way of example, U.S. Pat. No. 3,958,509 describes a method wherein the plate coverage of each ink key zone is determined by photo-electronic scanning of a portion of the printing plate. The ink key positions are calculated to be proportional to the plate coverage in a corresponding zone. U.S. Pat. Nos. 4,210,818, 4,187,435, and 4,180,741 also describe systems wherein ink keys are adjusted according to the plate coverage in a corresponding zone. Here, the plate coverage is determined using a light source to illuminate an image area such as a photographic film of the image or a printing plate to be printed and using light sensors to measure the light reflected from the film. Again, the ink key positions are calculated to be proportional to the plate coverage in a corresponding zone.

Other ink key preset systems are described in U.S. Pat. Nos. 5,170,711, 5,070,784, and 5,524,542. The systems described therein also account for various empirical parameters associated with the characteristics of the press, ink, type of job, and type of paper. These empirical parameters are typically learned from consistent usage of the preset system. Several different sets of parameters are often necessary for various types of printing jobs, especially for different plate coverages.

The above-described methods for presetting the ink keys are also somewhat inefficient and inaccurate because they do not take into account various factors such as ink back-flow, lateral ink spread, and ink saturation. Since substrate material is wasted until acceptable color is achieved, a more accurate method of presetting the ink keys will minimize the required number of adjustments while the press is running, saving both valuable time and material costs. Especially for print jobs of short duration, start-up waste can be a major percentage of total time and materials required.

Methods other than visual inspection of the printed image are also known for monitoring color quality once the press is running. These methods typically include measuring the optical density of a printed image. Optical density of various points of a printed image can be measured by using a densitometer or scanning densitometer either off-line or on-line of the web printing process. Off-line optical density measurements are performed by illuminating a test image with a light source and measuring the intensity of the light reflected from the image. Optical density (D) is defined as:

$$D=-\log_{10}(R)$$

where R is the reflectance, or ratio of reflected light intensity to incident light intensity. An effective on-line method for accurately measuring the optical density of a printed image is described in U.S. patent application Ser. No. 08/434,928, invented by John C. Seymour, Jeffrey P. Rappette, Frank N. Vroman, Chia-Lin Chu, Bradly S. Moersfelder, Michael A. Gill and Karl R. Voss, and assigned to the assignee of the present invention.

SUMMARY OF THE INVENTION

It is an object of the present invention to provide a system and method for accurate presetting of ink keys on a web-offset press. It is an additional object of the invention to provide a system and method for accurate control of ink keys on a web-offset press during runtime. It is a further object of the present invention to present a more accurate inking system model which accounts for various factors such as the effects of the roller train, the overall gain, and the relationship between optical density and ink film thickness on paper. Other factors included in the inking system model are the back-flow of ink from the ink fountain roller to the ink reservoir, the lateral movement of ink to adjacent ink key zones, the time constant required for an ink change, and delays between measurements and density changes.

Recent computer-to-plate technology has enabled the digital representation of an image to be directly transferred to a printing plate. Use of this digital pre-press data will also permit plate coverage to be easily and more accurately obtained.

BRIEF DESCRIPTION OF THE DRAWINGS

FIG. 14 illustrates the results obtained after solving the simultaneous equations of FIG. 13 assuming an ink film thickness on surface $S_0$ of one arbitrary unit ($t_0$=1) and a split ratio of 0.5 for all nip points and calculated for different values of plate coverage;

FIG. 23 is a table containing numerical values representing the ink key distribution function as a function of position in centimeters;

FIG. 24 is a vector equation for determining the ink film thickness on the web in the $i^{th}$ ink key zone;

FIG. 26 is an illustration of Toeplitz matrix VM formed from the ink key distribution function;

DESCRIPTION OF THE PREFERRED EMBODIMENT

Figure 1:
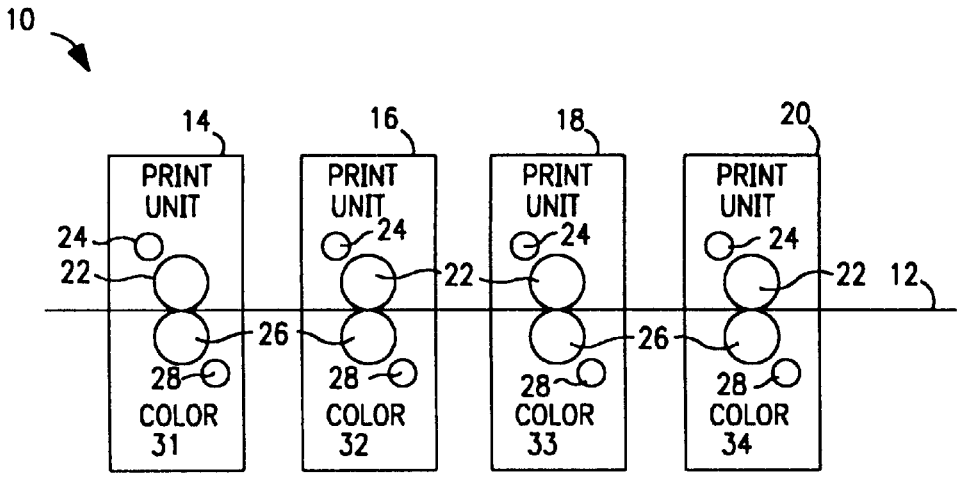
FIG. 1 is a block diagram of a web-offset printing system in accordance with the present invention.

Referring to FIG. 1, a web-offset printing system 10 for printing a multi-color image upon a web 12 is illustrated. In the preferred embodiment, four printing units 14, 16, 18, and 20 each print one color of the image upon the web 12. This type of printing is commonly referred to as web-offset printing. Each printing unit 14, 16, 18, 20 includes an upper blanket cylinder 22, an upper printing plate cylinder 24, a lower blanket cylinder 26, and a lower printing plate cylinder 28 to permit printing on both sides of web 12. In printing system 10, colors 31, 32, 33, and 34 on units 14, 16, 18, and 20 respectively, are typically black (K), cyan (C), magenta (M), and yellow (Y). The location of printing units 14, 16, 18, and 20 relative to each other is determined by the printer, and may vary.

Figure 2:
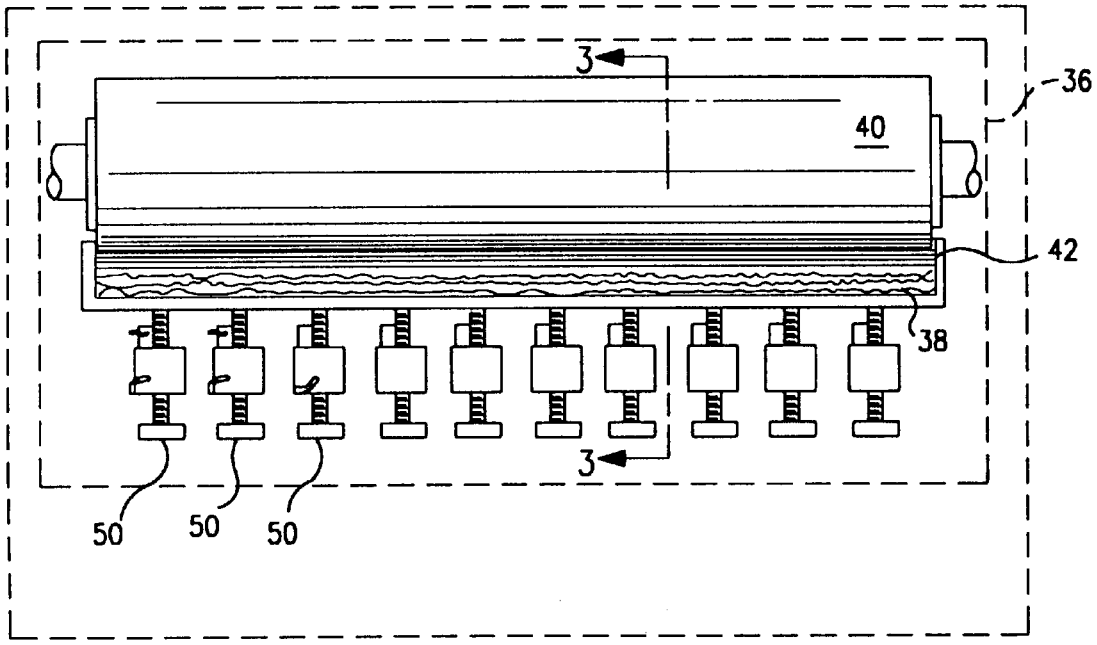
FIG. 2 is an illustration of an inking assembly including an ink fountain roller, ink reservoir, and ink keys.
Figure 3A:
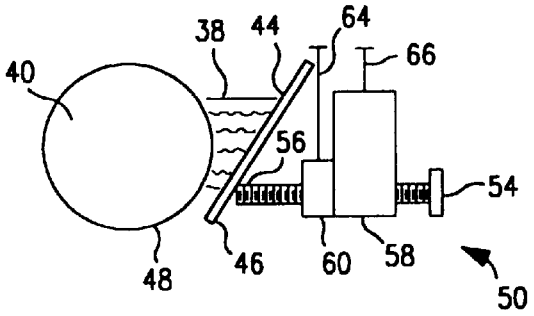
FIGS. 3(*a*) and 3(*b*) are side views of the inking assembly of FIG. 2, taken along line 3—3.
Figure 3B:
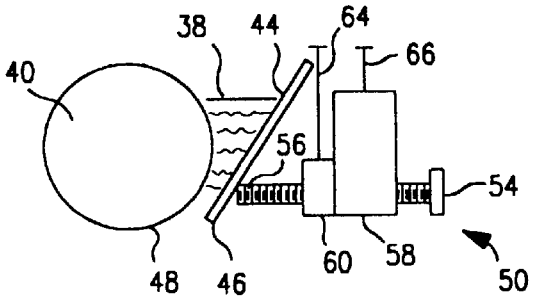

Each printing unit 14, 16, 18, and 20 includes an associated inking assembly 36 as shown in FIG. 2. Inking assembly 36 operates to supply ink to the web 12 in order to print images. Inking assembly 36 includes an ink reservoir 38 disposed adjacent an ink fountain roller 40 (also known as the ink ball) which extends laterally across the web. A blade 42 extends along the ink fountain roller 40 and is segmented so that the spacing of each segment relative to the ink fountain roller 40 can be independently adjusted. As shown in FIGS. 3(*a*) and 3(*b*), each blade segment 44 has an edge 46 which is moved toward and away from the outer surface 48 of the ink fountain roller 40 by adjustment of an associated ink flow adjustment device 50.

More specifically, a portion of the ink fountain roller 40 forms one main wall of the ink reservoir 38. The other principal wall of the reservoir 38 is provided by the blade segments 44. Ink passes from the ink reservoir 38 through the space between the surface of the ink fountain roller 40 and the lower edge 46 of the blade segment 44, and the spacing of the blade edge 46 to the ink fountain roller 40 acts to control the thickness of the ink film provided to the outer surface 48 of ink fountain roller 40.

A plurality of the ink flow adjustment devices 50 are disposed at equally-spaced lateral locations along the inking assembly 36 to press against the blade segments 44 at those locations to establish and adjust the size of the space between the roller 40 and the blade segment 44. Each ink flow adjustment device 50 includes an ink key 54 having screw threads engaging threads in a fixed portion of the frame of the inking assembly 36. The ink key 54 has a tip portion 56 which pushes against the associated blade segment 44 to deflect it and to thereby provide locally adjustable control of the spacing and the ink feed.

Figure 4:
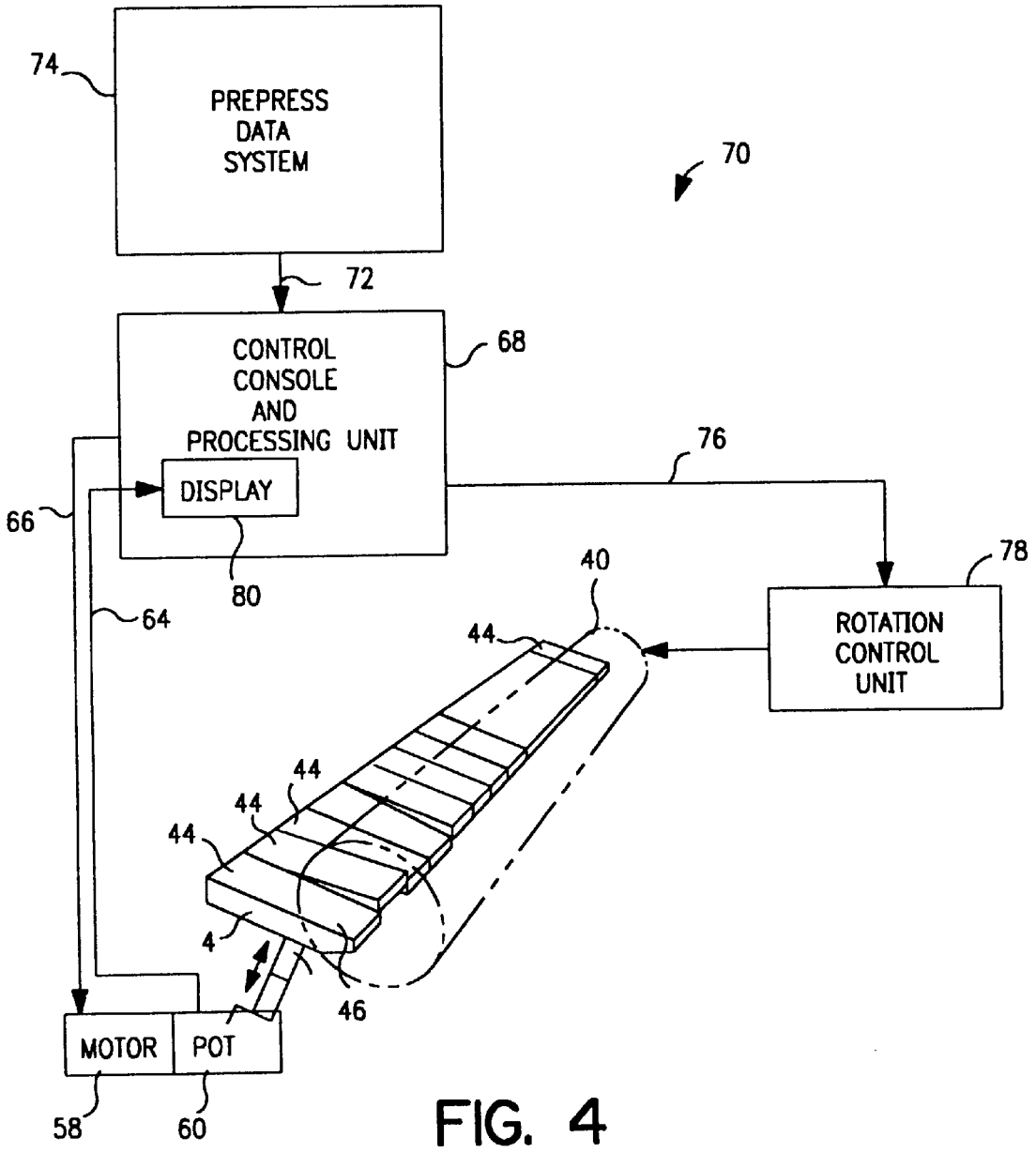
FIG. 4 is a schematic illustration of the ink key control system in accordance with the present invention.

The ink key 54 is driven by a bi-directional actuator motor 58 which operates to move the ink key 54 toward and away from the ink fountain roller 40. A potentiometer 60 has a movable arm mechanically connected with the ink key 54. The potentiometer 60 has a pair of outside electrical terminals and an inside electrical terminal located between the outside electrical terminals. The inside terminal of the potentiometer is mechanically connected to the movable arm of the potentiometer 60. The position of the movable arm of the potentiometer 60 depends upon the position of the ink key 54. The potentiometer 60 is energized at its outside electrical terminals so that an electrical signal indicative of the position of the ink key is produced at the inside electrical terminal of the potentiometer. The inside terminal of the potentiometer is electrically connected to line 64. The electrical signal on line 64 is connected as an input signal to the control console and processing unit 68 as shown in FIG. 4. The motor 58 is responsive to a signal on line 66 to position the ink key 54 as required.

With reference to FIG. 4, the general operation of an ink key control system 70 can be described. Ink key control system 70 operates to set the position of the ink keys to control the position of blade segments 44 in order to control the amount of ink fed to corresponding ink key zones on the web 12. A control console and processing unit 68 receives data on line 72 from a pre-press data system 74. The data on line 72 provides information regarding the plate coverage of the desired image. For example, optical plate scanners can be used to provide the data on line 72. As is known in the art, optical plate scanners typically provide appropriate plate calibration, uniformity corrections, and geometrical corrections. The data on line 72 could also be in a digital format from a system such as a CREO digital computer-to-plate system (CTP). Alternatively, the data on line 72 could be from a CTP file wherein the total image area is obtained simply by summing together the image areas. The data on line 72 from a CREO digital computer-to-plate system is typically an image in the conventional form of Tagged-Image-File-Format (TIFF) which represents the plate, typically in a 300 dot-per-inch format. This format provides far more resolution than is required for ink setting, and such large amounts of data are unwieldy.

The software program Photoshop (Version 4.0) is used to convert the bit-mapped TIFF files created by the platesetter into gray level images of lower resolution, finally output as raw files, which will be read in by the coverage calculation program in Appendix 1.

The control console and processing unit 68, in response to the plate coverage data and an appropriate inking system model as more fully described below, generates signals on line 66 to drive motors 58 to independently control the position of each blade segment 44. In addition, control console and processing unit 68 sends a signal via line 76 to rotation control unit 78. Rotation control unit 78 operates via a ratchet assembly (not shown) to control the amount of rotation of the ink fountain roller 40 during each stroke, as is known in the art.

Figure 5:
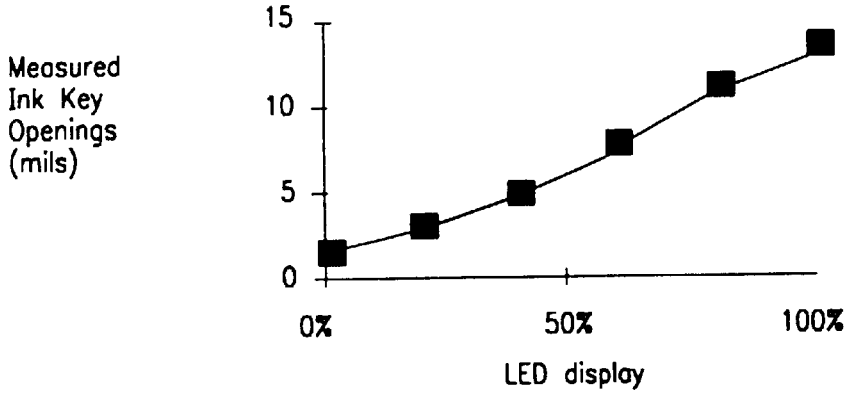
FIG. 5 is a graph depicting measured ink key opening versus displayed ink key opening.

An appropriate inking system model takes into account several different aspects of the inking system, from the ink reservoir 38 to the web 12. One aspect of the ink key control system 70 which is included in the model is the relationship between the actual ink key opening and the displayed ink key value at unit 68. As previously described, signals on line 66 from unit 68 are sent to corresponding motors 58 which move the associated blade segments 44. The position of each blade segment 44 is measured by means of an associated potentiometer 60 and displayed as a value on an LED display 80. (See e.g., U.S. Pat. No. 4,008,664). The relationship between the actual ink key openings, for example, as measured with a feeler gauge, and the displayed ink key values at display 80 is shown in FIG. 5. This relationship can be modelled with a linear gain and a calibration offset. Note that when the displayed value on display 80 is set to 0%, there is still a minimal key opening for lubrication purposes. The calibration offset additionally may be used to compensate for ink keys which are not adequately zeroed. The relationship between ink key openings and displayed ink key values is as follows:

$$P=a(I-b) \qquad \text{Equation 1}$$

where:

P is the ink key opening in mils,

I is the displayed ink key value in percent, a is a constant, measured at 0.14, b is the displayed value when the ink key opening is just closed.

Figure 6A:
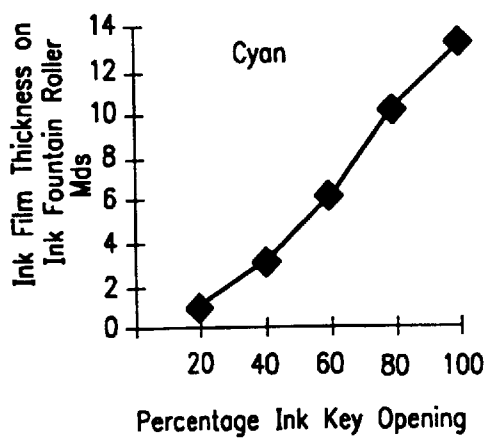
FIGS. 6(*a*)–6(*c*) are graphs illustrating ink film thickness on the corresponding ink fountain rollers and percentage ink key opening for ink colors cyan, magenta, and yellow.
Figure 6B:
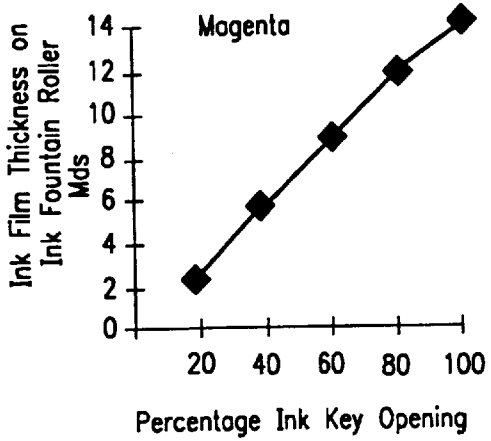
Figure 6C:
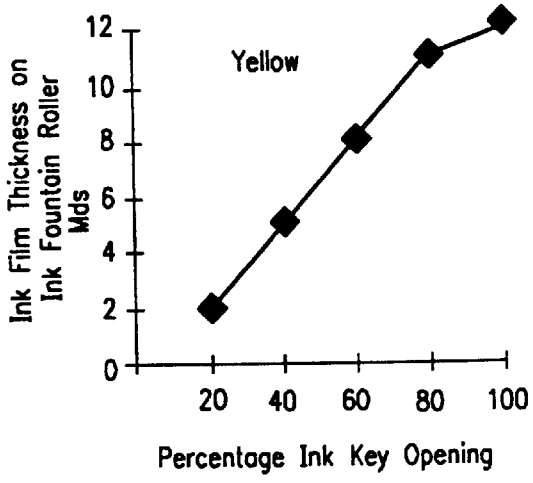

Another aspect included in the inking system model is the relationship between the ink film thickness on the ink fountain roller and the ink key opening. This relationship is illustrated in FIGS. 6(*a*)–6(*c*) for the ink colors cyan, magenta, and yellow. Ink film thickness on the ink fountain roller was measured using a laser displacement sensor such as an Omron Z4M-W40 instrument. This sensor uses a small laser spot less than 1 mm in diameter with triangulation to measure relative differences in height and has a resolution of 1.5 micron (0.06 mil). The results for cyan, magenta, and yellow inks suggest a linear relationship between the ink film thickness on the ink fountain roller and the ink key openings, although with different slopes, z. The relationship between ink film thickness on the ink fountain roller and the ink key opening is as follows:

$$T_b=z\,P \qquad \text{Equation 2}$$

where:

$T_b$ is the ink film thickness on the ink fountain roller 40 (in mils), z is a constant, which is dependent on the ink, P is the ink key opening as defined in Equation 1.

Figure 7:
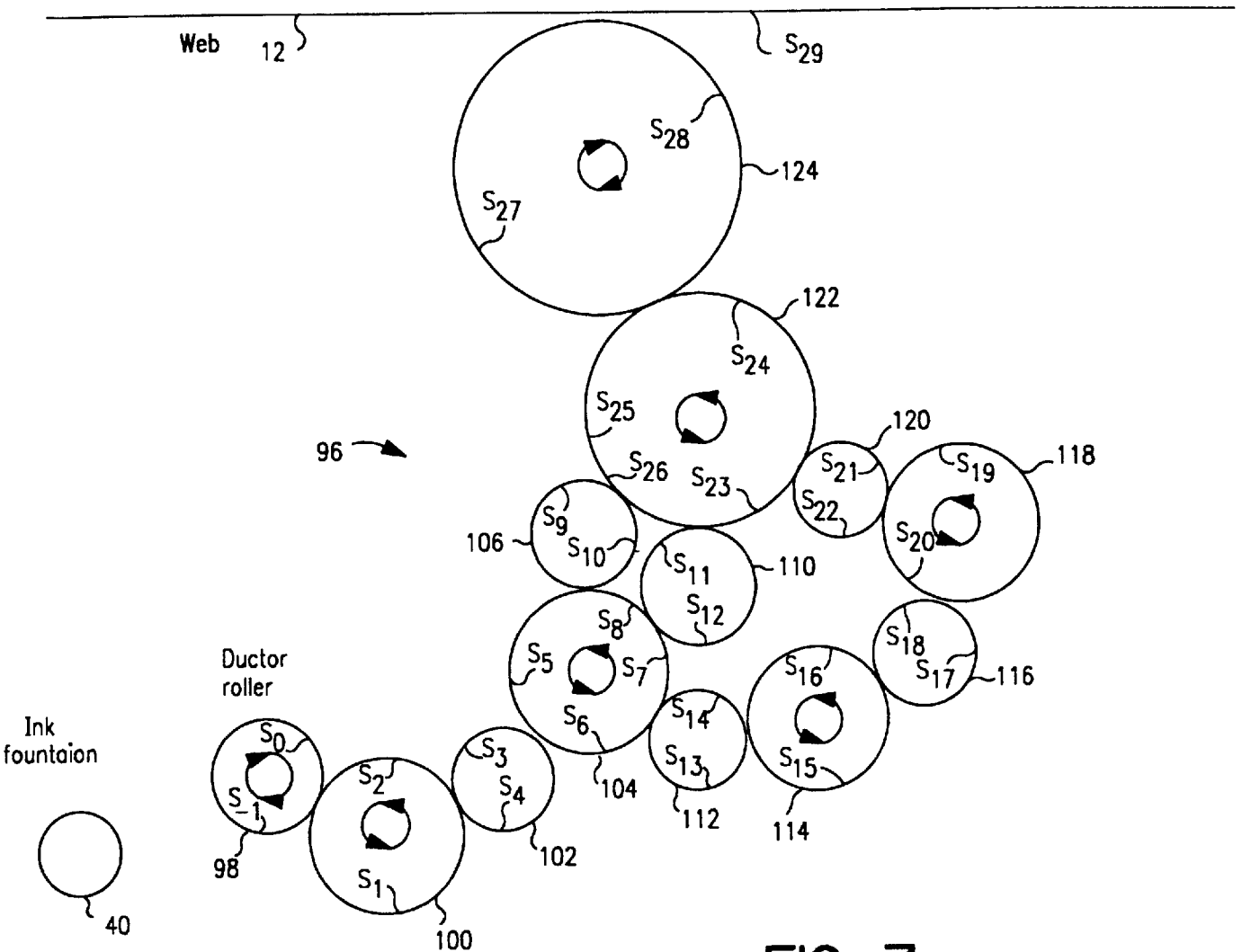
FIG. 7 is a schematic illustration of the roller train of the lower printing unit of a Harris M1000B printing press.

FIG. 7 is an illustration of a side view of a roller train 96 of a lower printing unit of a Harris M1000B printing press. Ink is supplied from the inking assembly 36 via the ink fountain roller 40 to a ductor roller 98 which continuously moves back and forth from contact with the ink fountain roller 40 and roller 100. Ink is then supplied from roller 100 to the various other rollers 102–124. Because it is not feasible to measure the ink film thickness on the ductor roller 98, the assumption is made that the relationship between the ink film thickness on the ink fountain roller 40 and the ink film thickness on the ductor roller 98 is also linear.

The rotation control unit 78 sets the ratchet setting to linearly control the angle that the ink fountain roller 40 rotates during each stroke. The rotation angle, along with the positions of the blade segments 44, determine the amount of ink transferred to the ductor roller 98. The relationship between rotation angle and the amount of ink transferred to ductor roller 98 is also assumed to be linear. Thus, the ink film thickness supplied to the ductor roller 98 in the roller train 96 is proportional to the product of the ink key opening and the ratchet setting. This relationship can be represented by:

$$T=g\,T_bR \qquad \text{Equation 3}$$

where:

T is the ink film thickness on the ductor roller 98, g is a constant related to the efficiency of ink transfer, $T_b$ is the ink film thickness on the ink fountain roller 40 (defined in Equation 2), R is the ratchet setting (in relative amount from 0 to 1).

Another necessary aspect of the model is the relationship between the ink required at the ductor roller and the plate coverage (without considering the effect of the vibrator rollers). Various plate coverage equations can be used. A model-based plate coverage equation can be derived as described below.

Referring back to FIG. 7, the arrows indicate the direction of rotation of rollers 98–124. Rollers 100, 104, 114, and 118 are vibrator rollers which also oscillate back and forth in a lateral direction with respect to the web 12, thereby operating to spread ink from one ink key zone to adjacent ink key zones.

Figure 8:
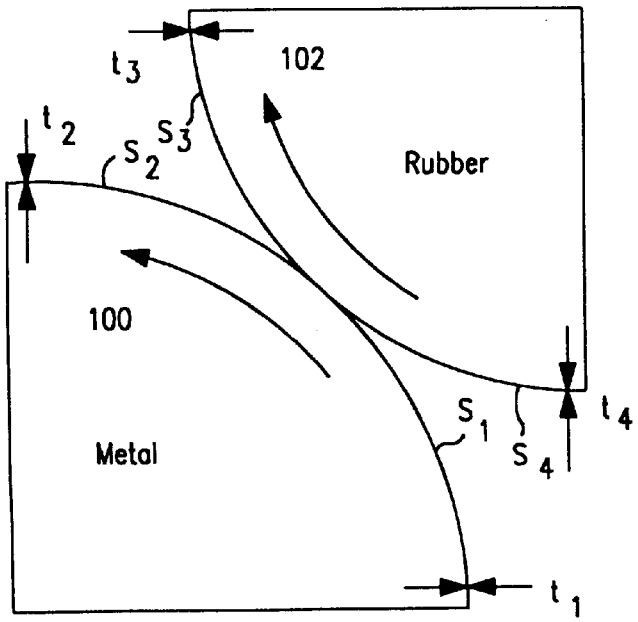
FIG. 8 is an illustration of a nip point between two rollers, wherein ink is transferred from roller 100 to roller 102.

Outer surfaces $S_{-1}$, $S_0$, $S_1$, . . . ,$S_{28}$ of rollers 98–124 have associated ink film thicknesses $t_{-1}$, $t_0$, $t_1$, $t_{28}$. The ink film thickness on the web surface $S_{29}$ is designated as $t_{29}$. In order to calculate $t_{29}$, the complete roller train 96 (from the ductor roller 98 to the web 12) is modelled based on the assumption of continuity of ink film thickness. Rollers 100 and 102 and associated surfaces $S_1$–$S_4$ as well as ink film thicknesses $t_1$–$t_4$ are shown in FIG. 8. Ink is transferred from roller 100 to roller 102. In particular, roller 100 is made of metal, and roller 102 is made of rubber. Two equations can be derived to relate ink film thicknesses between rollers at each nip point:

$$t_2=k(t_1+t_4) \qquad \text{Equation 4}$$

$$t_3=(1-k)(t_1+t_4) \qquad \text{Equation 5}$$

where:

$t_n$ is the ink film thickness on surface $S_n$, n=1 to 4, k is the ink split ratio between the metal roller and the rubber roller.

Figure 9:
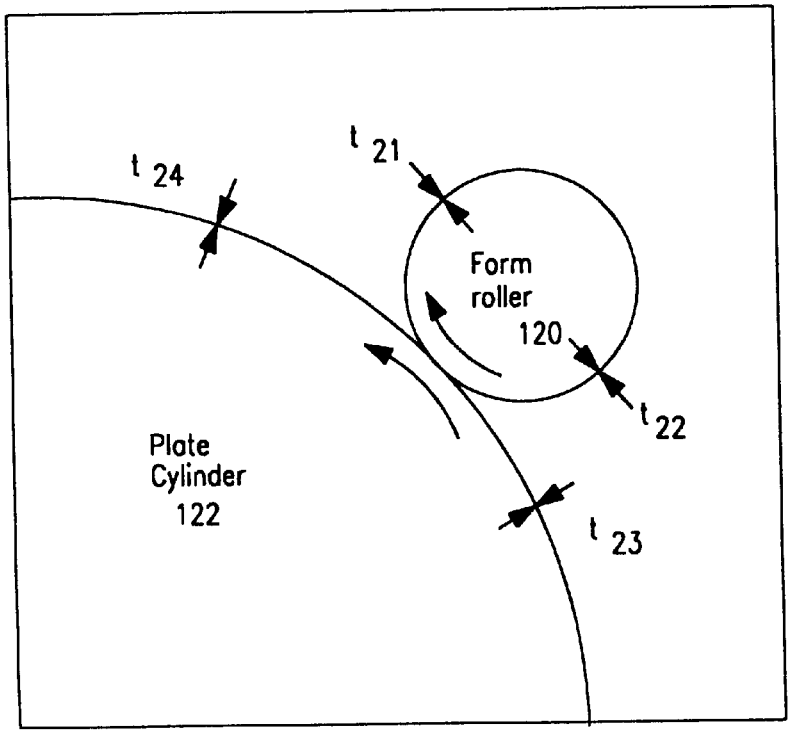
FIG. 9 is an illustration of a nip point between a form roller 120 and the plate cylinder 122.

Equations similar to Equation 4 and Equation 5 are sufficient to describe the ink film thickness on each roller surface in the roller train 96, except for the ink film thickness on the plate cylinder, roller 122. The surface of the plate cylinder 122 includes a printing plate comprising the image to be printed. A different set of equations are applicable to the nip point between a form roller 106, 110, 120 and the plate cylinder 122. Although form rollers 106, 110, and 120 perform similar functions, roller 120 will be used in this example. Referring to FIG. 9, ink is transferred from the form roller 120 to the plate cylinder 122. For the areas of the plate cylinder 122 which have solid coverage, the nip equations remain the same as Equations 4 and 5. For the areas of the plate cylinder 122 which have zero coverage, the plate cylinder 122 does not receive any ink and all the ink remains on the form roller 120. It is necessary to include the plate coverage, c, in the equations as follows:

$$t_{24}=k(t_{23}+t_{22}) \qquad \text{Equation 6}$$

$$t_{21}=(1-c)t_{22}+c(1-k)(t_{22}+t_{23}) \qquad \text{Equation 7}$$

where:

$t_{22}$ is the ink film thickness on form roller 120 before the nip point, $t_{21}$ is the ink film thickness on form roller 120 after the nip point, $t_{23}$ is the ink film thickness on plate cylinder 122 before the nip point, $t_{24}$ is the ink film thickness on plate cylinder 122 after the nip point, k is the split ratio for plate cylinder 122, c is the plate coverage.

Because of the principle of conservation of ink, the following equation relates the ink supplied to the ductor roller 98 and the ink supplied to the web surface $S_{29}$:

$$t_0-t_{-1}=t_{29} \qquad \text{Equation 8}$$

where:

$t_0$ is the ink film thickness on surface $S_0$ of the ductor roller 98, $t_{-1}$ is the ink film thickness on surface $S_{-1}$ of the ductor roller 98 (ink returned to the ink reservoir 40), $t_{29}$ is the ink film thickness on web surface $S_{29}$.

Figures 12, 13:
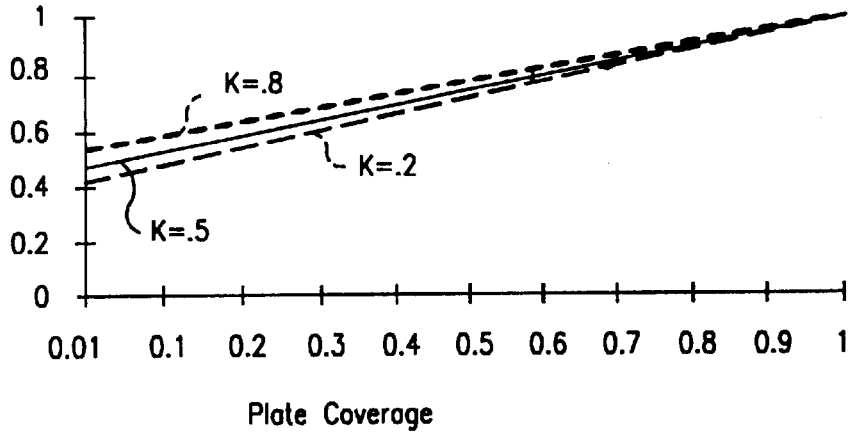
FIG. 12 is a graph depicting the relationship between relative ink key opening and relative plate coverage for three different values of the split ratio, k.
FIG. 13 is a set of simultaneous equations, relating ink thicknesses at each nip point of the roller train 96.

Using Equations 4–8, equations are formed for each nip point of the roller train 96 and the set of resulting simultaneous equations is solved for ink film thickness at each surface $S_{-1}$–$S_{29}$. The complete set of equations is shown in FIG. 13. Assuming an ink film thickness on surface $S_0$ of one arbitrary unit ($t_0$=1) and a split ratio of 0.5 for all nip points, the ink film thickness at each surface is calculated for varying coverages corresponding to c=0.1, 0.3, 0.5, 0.7, 0.9, and 1.0. These results are presented in FIG. 14.

Figure 10:
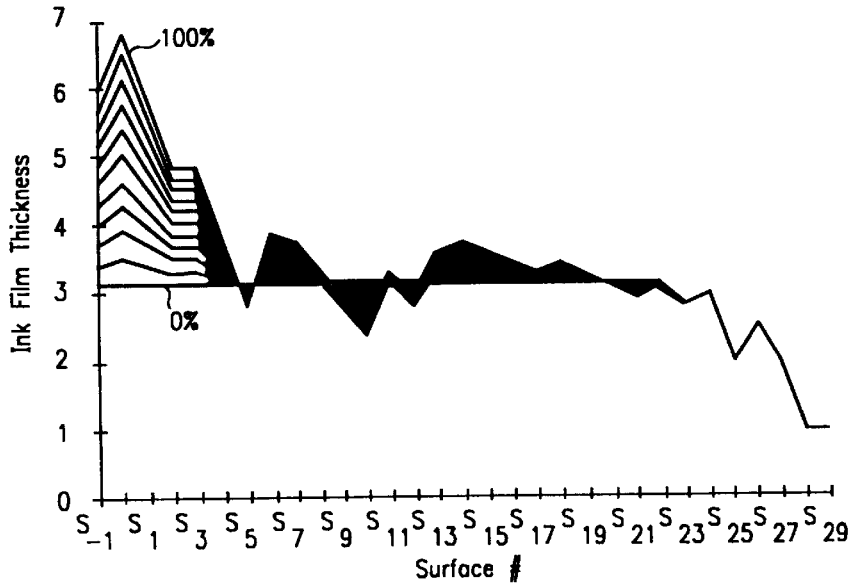
FIG. 10 is a graph depicting ink film thickness at various surfaces of the roller train of FIG. 7, wherein each curve corresponds to a different value of coverage from 0% to 100%.

FIG. 10 is essentially another way of displaying the data of FIG. 14, with the data normalized differently. FIG. 10 shows a series of curves depicting ink film thickness (in arbitrary units) at each surface $S_{-1}$–$S_{29}$ of the roller train 96. Each curve corresponds to a different value of plate coverage from 0% to 100%. FIG. 10 demonstrates that if the ink film thickness is desired to be 1 arbitrary unit on the web surface $S_{29}$, then the ink film thickness fed to the roller 98 has to be approximately 3 to 7 units, depending on the plate coverage.

Again assuming an ink film thickness on surface $S_0$ of one arbitrary unit and a split ratio of 0.5 for all nip points, the set of simultaneous equations of FIG. 13 can be written as a matrix. This matrix can be symbolically inverted and solved for $t_{29}$ in terms of the plate coverage, c, as follows:

Equation 9:

$$t_{29} = \frac{7 + 16c + 5c^2}{22 + 76c + 74c^2 + 20c^3}$$

Figure 15:
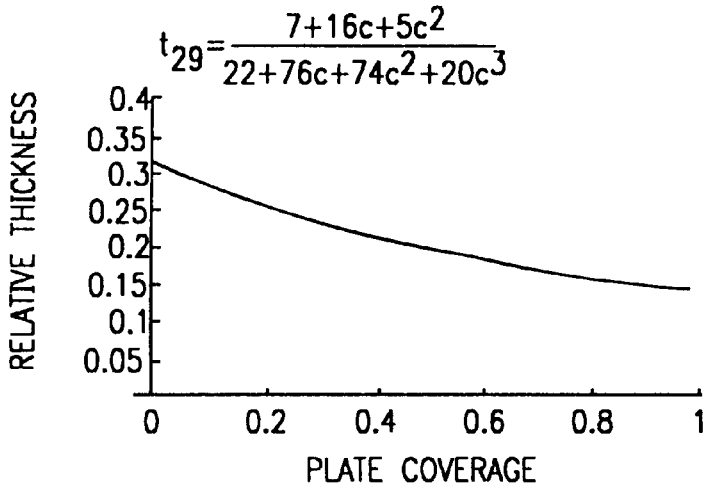
FIG. 15 illustrates a plot of the relationship between relative ink film thickness on paper and plate coverage.

FIG. 15 illustrates a plot of this equation, i.e., relative ink film thickness on paper versus plate coverage.

Figure 11:
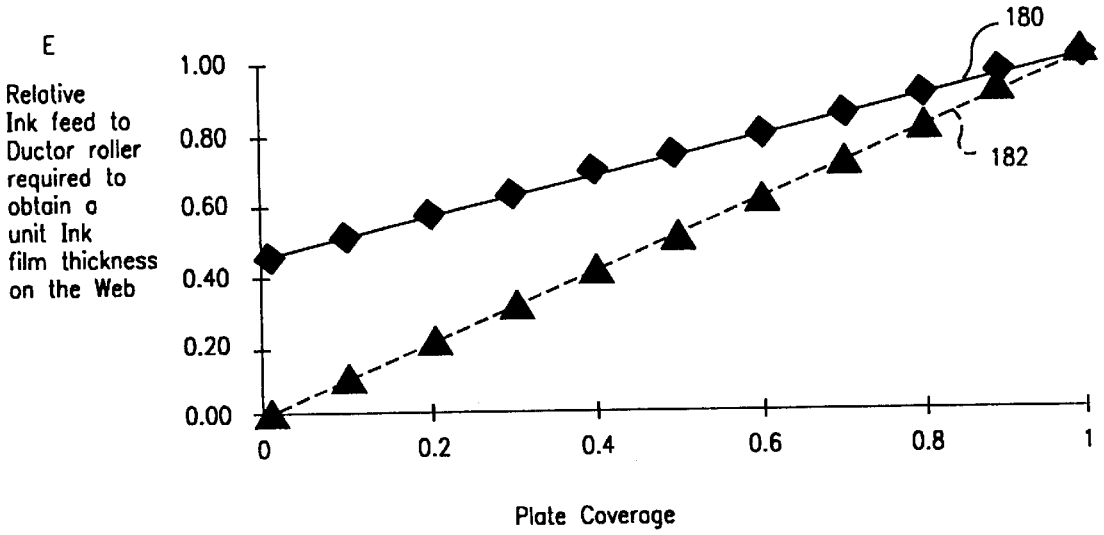
FIG. 11 is a graph depicting relative ink feed to the plate versus relative plate coverage according to two different models.

Another way to look at the relationship of FIG. 15 is to note that the reciprocal of Equation 9 can be normalized to have a value of 1.0 at c=1.0. The results of taking the reciprocal of $t_{29}$ and normalizing are shown by the data points indicated by diamonds in FIG. 11. This is the model-based plate coverage equation. The relationship between the diamond data points can be approximated by a straight line, line 180. The equation for the line 180 is as follows:

$$E=0.54c+0.46 \qquad \text{Equation 10}$$

where:

E is the relative ink utilization factor, c is the plate coverage.

Equation 10 represents a linear plate coverage equation having a non-zero offset. The normalized reciprocal of $t_{29}$ provides a relative ink utilization factor, or in other words, a measure of the relative ink thickness at the ductor roller 98 which is necessary to obtain an ink film thickness of 1 arbitrary unit on the web.

Equation 10 indicates that an ink feed of 46% of that required for full coverage is needed even for 0% plate coverage. This contradicts the conventional paradigm that no ink is needed if there is 0% coverage. The conventional paradigm of how much ink feed is required for 0% coverage is illustrated as line 182 in FIG. 11. Line 182 is a proportional plate coverage equation. According to the conventional paradigm, the ink key should not be opened if the plate coverage is zero. However, the conventional paradigm is not accurate because it ignores the fact that the ink is not only being transferred forward to the web 12, but that part of the ink is also transferred back to the ink reservoir 38. Again, the difference between the ink supplied to the ductor roller 98 and the ink returned to the reservoir 38 must equal the ink supplied to the web in order to take into account the total amount of ink. Thus, it must be kept in mind that the ink key opening is directly related to the ink supply and not to the ink consumption. It should also be noted that in order to print uniformly across the web, the ink film thickness has to be maintained uniformly across the form rollers (which transfer ink to the printing plates), even if there is only a tiny dot to be printed in a certain ink key zone.

Note that Equation 10 was derived from data obtained on a Harris M1000B press; however, the same approach can be applied to any inking train arrangement. Furthermore, direct measurement can be made, for example, by utilizing a sequence of plates with progressively higher coverage. In particular, an empirically-based plate coverage equation can be determined by taking a series of measurements using plates having for example, three portions, each portion having a different percentage solid ink coverage. The portions should be wide enough so that the vibrator rollers do no influence the results. Also, the plate should have solid coverage so dot gain problems do not influence the results. The first plate is used to print images and measurements are taken at points in the middle of each portion. The press conditions should remain the same while another similar plate having different plate coverage percentage values is used to print images, and more measurements are taken.

The sensitivity of E, the relative ink utilization factor, to changes in the split ratio, k, was investigated by calculating corresponding lines for various values of the split ratio. In particular, k was set to 0.2, 0.5, and 0.8, corresponding to ink favoring metal rollers, rubber and metal rollers equally favoring ink, and ink favoring rubber rollers, respectively. The results are illustrated in FIG. 12 and demonstrate that the assumption of a fixed split ratio of 0.5 does not drastically affect the results of FIG. 11.

The relationship between the optical density of an ink film and the ink film thickness on the web is another aspect of the inking system model. A first-order approximation of that relationship is that the optical density is proportional to ink film thickness on the web. However, the first-order approximation fails to account for the phenomena of saturation. A better model for the relationship is as follows:

$$D=D_t(1-e^{-mF}) \qquad \text{Equation 11}$$

where:

D is the solid ink density, $D_t$ is the saturation density, i.e., the density of an infinitely thick ink film, m is a constant, F is the ink film thickness on the web.

The saturation density, $D_t$, depends most strongly upon the smoothness of the substrate. Uncoated paper will have a much lower saturation density than coated paper. Another factor which affects the saturation density is the particular ink used. For example, yellow ink has a lower saturation density than black ink. The constant m is the ink strength parameter, which depends largely upon the tinctorial strength of the ink, that is, the amount of pigment.

Figure 16:
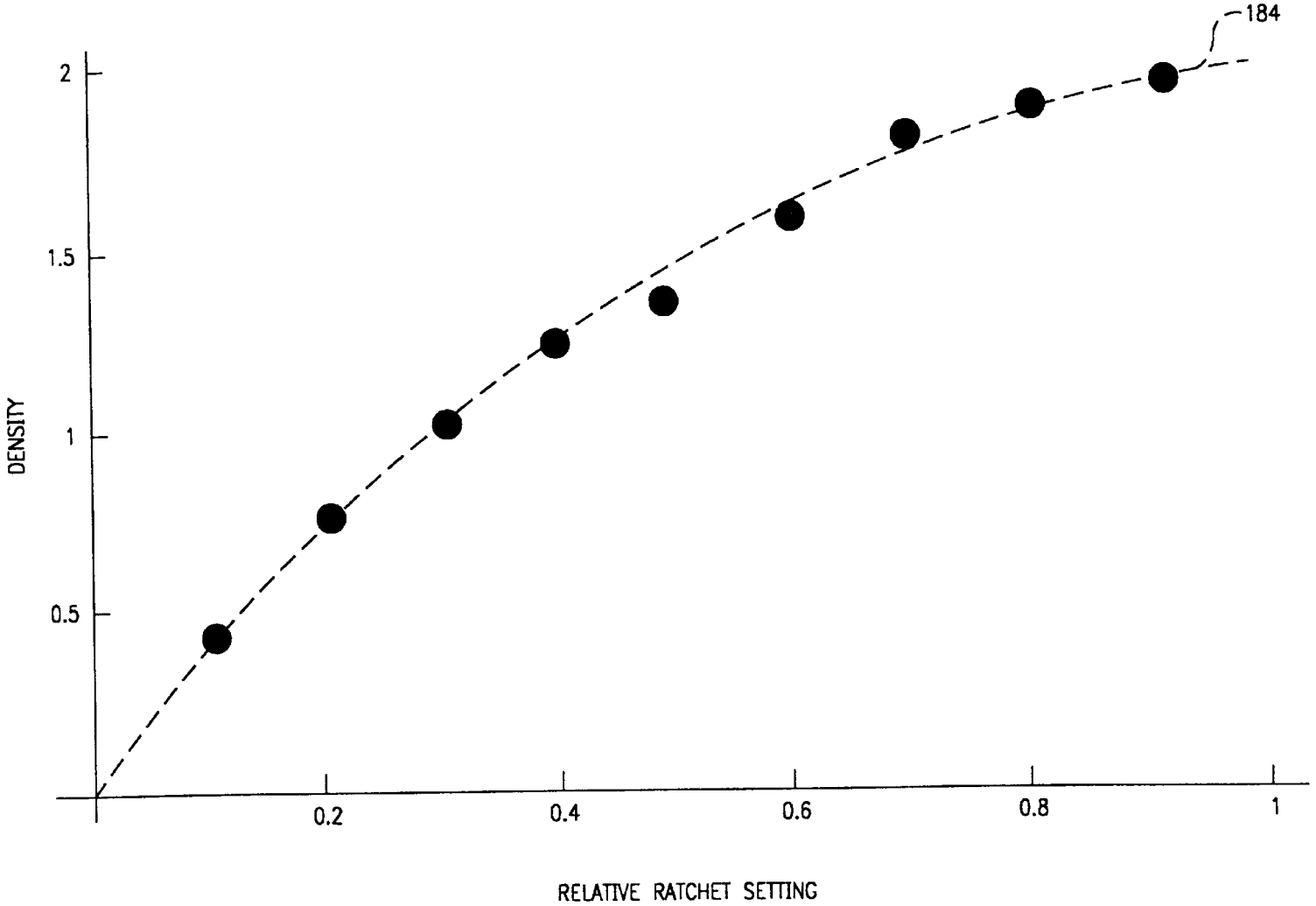
FIG. 16 is a graph depicting the relationship between density and relative ratchet setting.

Equation 11 is commonly known as the Tollenaar-Ernst formula. In order to determine constants m and $D_t$, an experiment was performed wherein the ratchet assembly was set to various percentages, e.g. 10%, 20%, 30%, . . . , 90%, a solid image was printed and its optical density measured. FIG. 16 plots density versus relative ratchet setting. Given a required density, FIG. 16 permits the determination of the relative ratchet setting that would yield that particular density. Assuming that the ink film thickness is proportional to relative ratchet setting, the constants m and $D_t$ in Equation 11 can be determined. Performing a least squares fit to the data points of FIG. 16 results in the following equation for curve 184:

$$D=2.45(1-\exp(-1.81\ t_{29}) \qquad \text{Equation 12}$$

Equation 12 can be rearranged to solve for $t_{29}$:

Equation 13:

$$t_{29} = \frac{\ln(1 - D/2.45)}{-1.81}$$

The Tollenaar-Ernst formula was used to model the relationship between ink film thickness and density. One skilled in the art will be aware of other, similar equations, which empirically describe this relationship. For example, six different equations are provided in Chou, Shem, "Relationship Between Ink Mileage and Ink Transfer", in the 1991 TAGA Proceedings.

Figure 17:
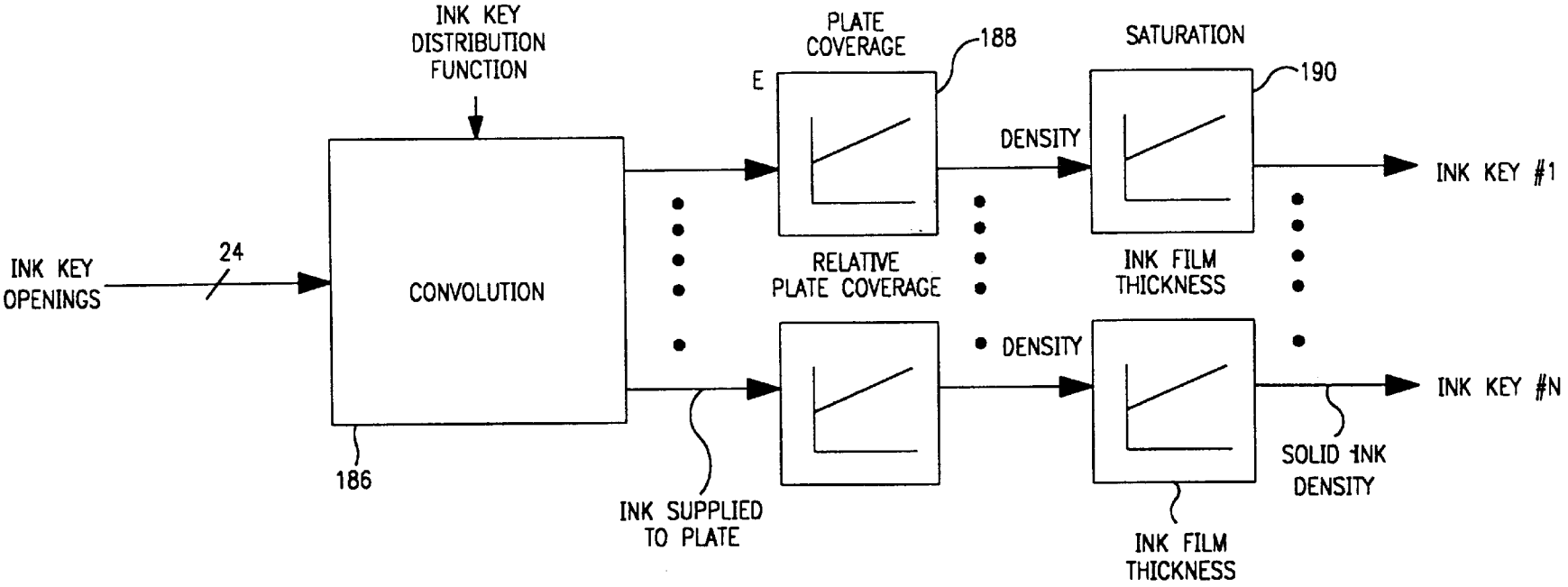
FIG. 17 is a depiction of the inking system model with an unknown ink key distribution function.

The inking system model so far described by Equations 10 and 12 is best illustrated as shown in FIG. 17. The description of the model at this point is not complete because the effect of the lateral movement of the vibrator rollers on the ink flow has not been taken into account. It is assumed that the effect of the vibrator rollers on ink flow can be modelled using an ink key distribution function which is convolved with the ink key openings. In other words, a convolution model is one in which it is assumed that opening a given ink key will result in a fixed percentage of ink being transferred to each of the neighboring ink key zones. The convolution model further assumes that the percentage of ink deposited on a particular zone is independent of the magnitude of the ink key opening as well as independent of plate coverage.

FIG. 17 therefore depicts a portion of the inking system model wherein the ink key openings convolved with an ink key distribution function (at block 186) provides information regarding the amount of ink supplied to the plate cylinder. The relative ink utilization factor, E, which is a function of plate coverage in each ink key zone, is implemented at block 188, and provides information regarding the ink thickness required at the web. An ink saturation block 190 relates ink film thickness to density values.

Figure 18:
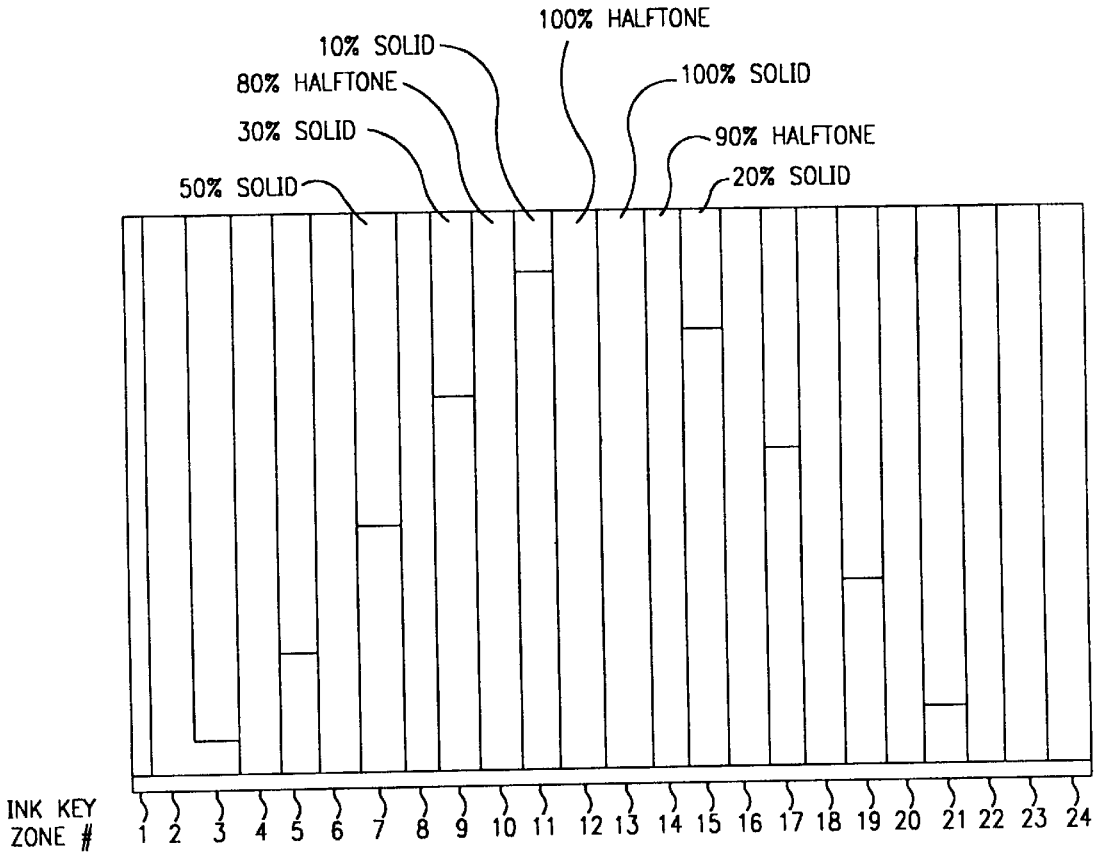
FIG. 18 is an illustration of the printing plate test design.

The form of the ink key distribution function was determined by conducting various tests on a Harris M1000B printing press using the printing plate test design of FIG. 18. The test design consists of a series of vertical strips, each of which corresponds to one ink key on the press. The width of each strip is four centimeters, which corresponds to the width of the blade segment 44 controlled by each ink key (i.e., the width of the associated ink key zone). The odd-numbered ink key strips in the test design have solid coverages which extend for varying lengths of the plate. The even-numbered ink key strips have varying halftone coverages which extend the full length of the plate. The test design thus includes two ink key zones for each step in coverage amount (i.e., 0%, 10%, 20%, . . . , 100%). One ink key strip achieves a given plate coverage by solid coverage over a percentage of the plate length, and the other achieves the same plate coverage by a corresponding halftone percentage extending the full plate length.

Figure 19:
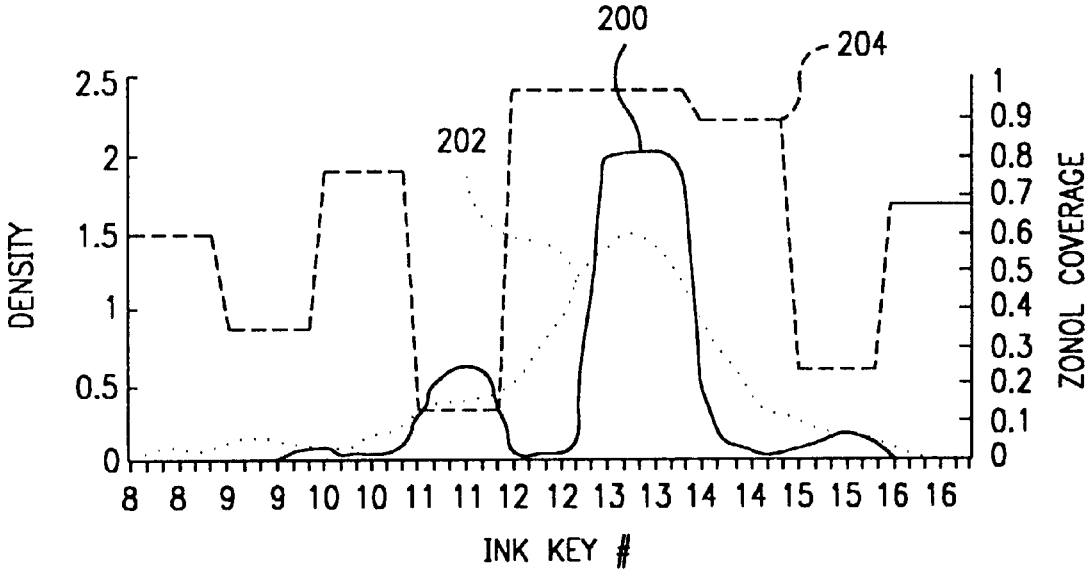
FIG. 19 is an illustration of density versus ink key position using the printing plate test design of FIG. 18 with the vibrator rollers disabled and then enabled; curve 204 illustrates plate coverage plotted versus ink key number.

A test was conducted in which the vibrator rollers were disabled and all the ink keys were closed except ink key #13. Note that ink key #13 corresponds to a solid strip extending the length of the plate and which is sandwiched by a pair of 90% halftone strips. The optical densities of the corresponding ink key zones of the printed image were then measured. As shown by solid curve 200 in FIG. 19, the optical density of the solid strip was measured to be 2.1, and the densities for the neighboring halftone strips were approximately 0.15. This demonstrates that ink does not flow to the neighboring zones just because of the demand from zones of high coverage or because of roller pressure. Instead, ink is distributed to neighboring zones exclusively by the forceful motion of the vibrator rollers. The smooth transitions at the borders between zones are due to the fact that the vibrator rollers could not be totally disabled and a minimal travel distance of 0.25 inches remained in effect. For an example of ink distribution in the total absence of vibrators, see FIG. 8 of "About Measurement and Computation of Ink Transfer in Inking Units of Printing Presses," Scheuter & Rech, in the 1990 TAGA Proceedings. The density at the zone corresponding to ink key #11 rose to 0.6 which was due to the combined effect of a minimal ink key opening required for lubrication, and the fact that the zonal coverage corresponding to ink key #11 was very low, i.e. 10%.

Figure 20:
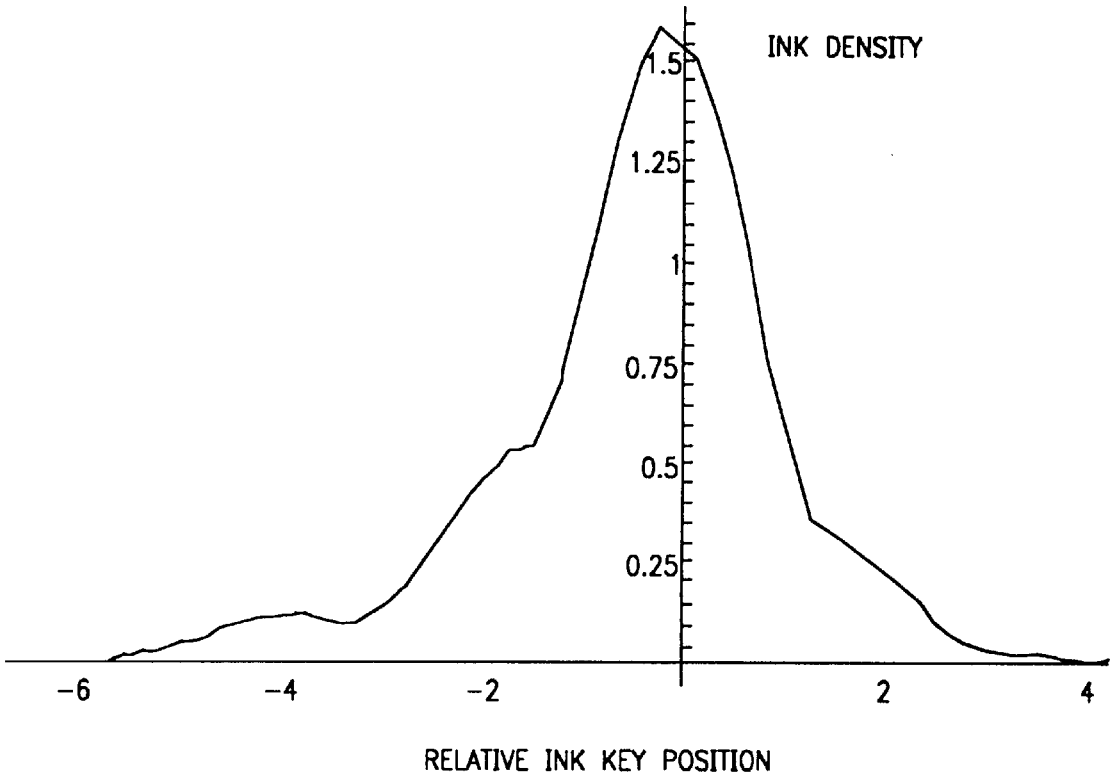
FIG. 20 is a more detailed plot of curve 202 of FIG. 19.

Normally, the vibrator rollers have a lateral travel of roughly 1.5 inches. The ink distribution with the vibrator rollers enabled is illustrated as curve 202 of FIG. 19. FIG. 20 is a more detailed plot of curve 202 of FIG. 19. Solid ink density is plotted versus relative ink key position, with the zero point of the plot corresponding to the center of the ink key which was opened (key #13). Densities were measured every one centimeter in the printed image corresponding to the solid black bar at the bottom of the test design. It appears that curve 202 is stretched out with respect to curve 200 for at least two to three key zones on each side of the zone corresponding to ink key #13, due to the fact that there were four vibrator rollers in a Harris M1000B printing press. It is assumed that the shape of curve 202 is asymmetrical due to the coverage differences between zones. Curve 204 illustrates plate coverage plotted versus ink key number. After correcting curve 202 for differences in plate coverage, a more symmetrical ink spread curve is obtained, as more fully described below.

Figure 21:
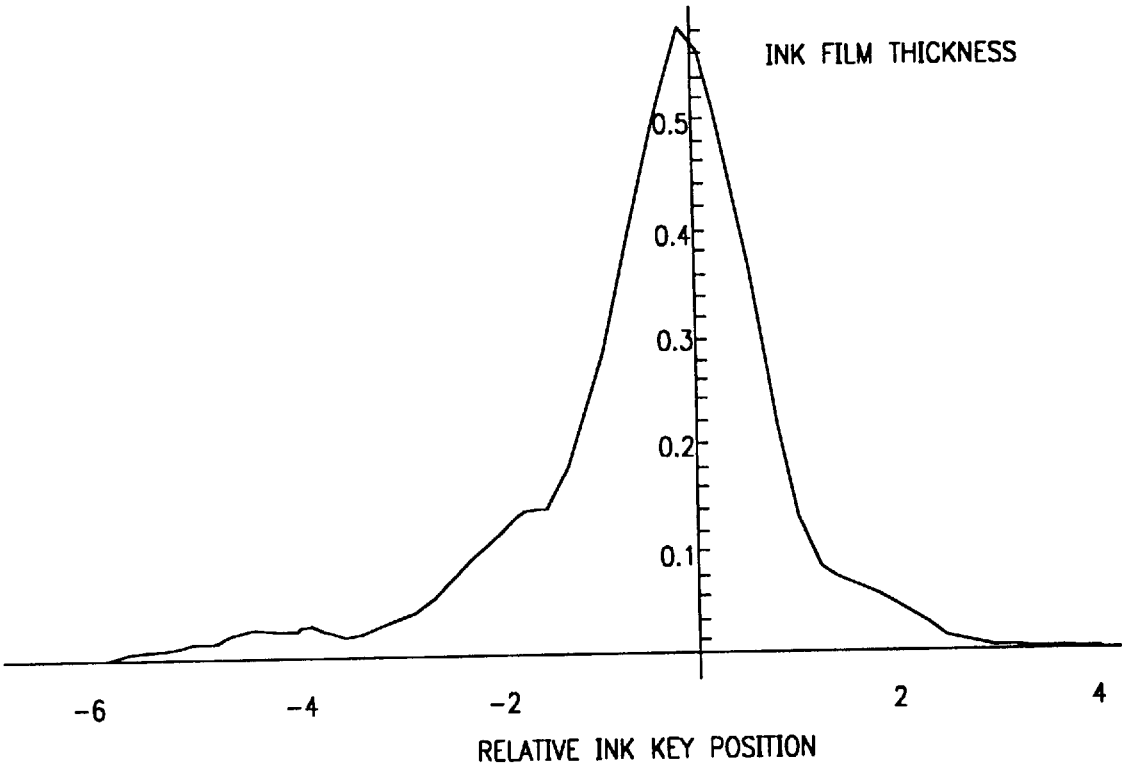
FIG. 21 is an illustration of the results obtained by applying Equation 13 to the data of FIG. 20.

Referring back to FIG. 17, in order to determine the form of the ink key distribution function, the measured density data illustrated in FIG. 20 is corrected first for the effects of ink saturation, and then for plate coverage. In other words, working from measured density values (starting on the right hand side of FIG. 17), corrections are performed from right to left to determine the corresponding ink key settings. FIG. 21 illustrates the results of applying Equation 13 (i.e., the inverse of the saturation ink formula) to the data of FIG. 20 to obtain a plot of ink film thickness versus ink key position (relative to ink key #13).

To take into account the differences in plate coverage between each ink key zone, utilization of Equation 10 is required. Equation 10 takes into account the relative efficiency of each ink key zone's use of a given ink film thickness. Areas of very low plate coverage will use the ink which is spread by the vibrator rollers "more efficiently" than ink key zones having a higher plate coverage. A low coverage area will therefore require a relatively smaller ink key opening. Therefore, to calculate the required ink key setting to achieve a predetermined solid ink density, a multiplication by the relative ink utilization factor (which is dependent on plate coverage) is required. The solid line in FIG. 22 shows the results of applying Equation 10 to the curve of FIG. 21 (or applying both Equation 10 and Equation 13 to the original data of FIG. 20).

Figure 22:
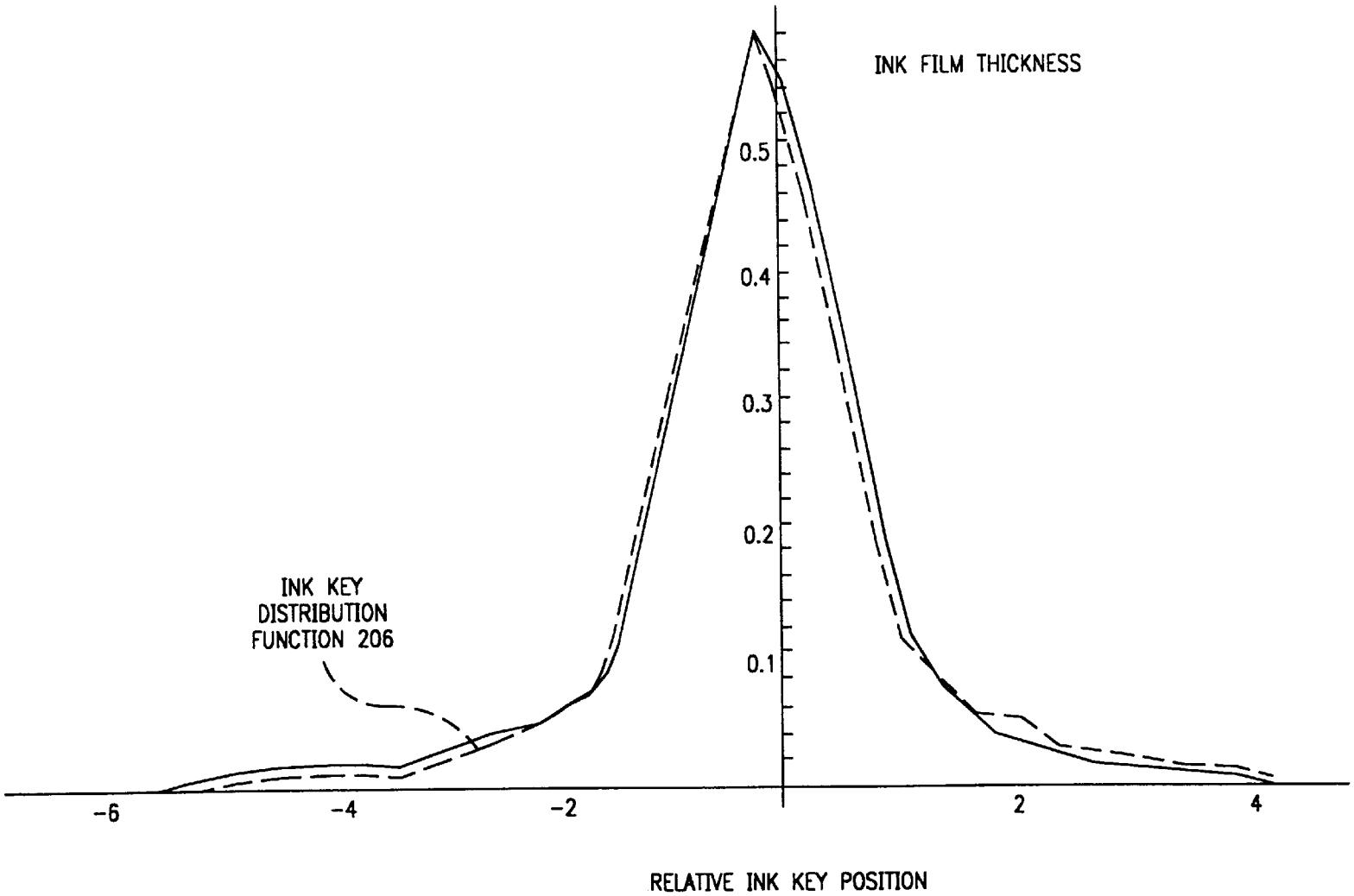
FIG. 22 is an illustration of the empirically determined ink key distribution function.

The dotted line in FIG. 22 represents a symmetrified version of the data, obtained by averaging corresponding points on either side of the peak. This dotted line represents the ink key distribution function 206. This is the spread of ink from a source of ink which is the width of an ink key zone. This is not a "point spread function" due to the ink spread from a single point of ink. The ink key distribution function 206 is the convolution of the true point spread function with a pulse function which is the width of an ink key zone.

FIG. 23 is a table containing numerical values representing the ink key distribution function 206 as a function of position in centimeters. Another way to represent this data is by way of a vector V:

$$V=[0.007\ 0.009\ 0.016\ 0.043\ 0.196\ 0.460\ 0.196\ 0.043\ 0.016\ 0.009\ 0.007]$$

Vector V is obtained by averaging the data in FIG. 23 over the width corresponding to each ink key zone (four centimeters), and then scaling so that the addition of all vector elements adds up to 1. The elements in vector V can then be interpreted as the fraction of ink which is distributed to a specific ink key zone. Each ink key results in its own distribution of ink, which is proportional to the ink key opening. For the Harris M1000B press, 46% of the ink provided by a given ink key is passed directly into its corresponding ink key zone, 20% is passed to the immediate neighboring zones, and 4% is passed to the next set of neighbors, and so on.

A vector equation relating the ink film thickness on the ductor roller 98 to the ink film thickness presented to the plate cylinder 122 can be written as follows:

$$L_i = V\,TD \qquad \text{Equation 14}$$

where:

$L_i$ is the ink film thickness on an imaged area of the printing plate on the plate cylinder 122 at the $i^{th}$ ink key zone, V is the vector representing ink key distribution function, TD is the following vector:

$[T_{i-5}\ T_{i-4}\ T_{i-3}\ T_{i-2}\ T_{i-1}\ T_i\ T_{i+1}\ T_{i+2}\ T_{i+3}\ T_{i+4}\ T_{i+5}]^T$ wherein:

$T_i$ is the ink film thickness on the ductor roller 98 at the $i^{th}$ ink key zone.

Taking into account Equation 10, the relationship between the ink film thickness at the plate cylinder 122 and the ink film thickness on the web 12 can be represented by the following vector equation:

Equation 15:

$$F_i = \frac{L_i}{(.54\,C_i + .46)}$$

where:

$F_i$ is the ink film thickness on the web in the $i^{th}$ ink key zone, $L_i$ is the ink film thickness on an imaged area of the printing plate on the plate cylinder 122 at the $i^{th}$ ink key zone, $C_i$ is the plate coverage for the $i^{th}$ ink key zone.

Using equations 1, 2, 3, 13, and 14, the ink film thickness on the web in the $i^{th}$ ink key zone can be rewritten as the following vector equation:

Equation 16:

$$F_i = \frac{GRV(I_i - b_i)}{(.54\,C_i + .46)}$$

where:

$F_i$ is the ink film thickness on the web at the $i^{th}$ ink key zone, (i is the zonal index, from 1 to 24), G is the overall system gain, (which takes into account constants a, z, and g)

R is the ratchet setting, $C_i$ is the plate coverage in the $i^{th}$ ink key zone, V is the vector representing ink key distribution function, $(I_i - b_i)$ is a vector representing zonal key opening minus its calibration offset, at ink key zones centered about the $i^{th}$ ink key zone.

In particular, Equation 16 is shown in more detail in FIG. 24.

Figure 25:
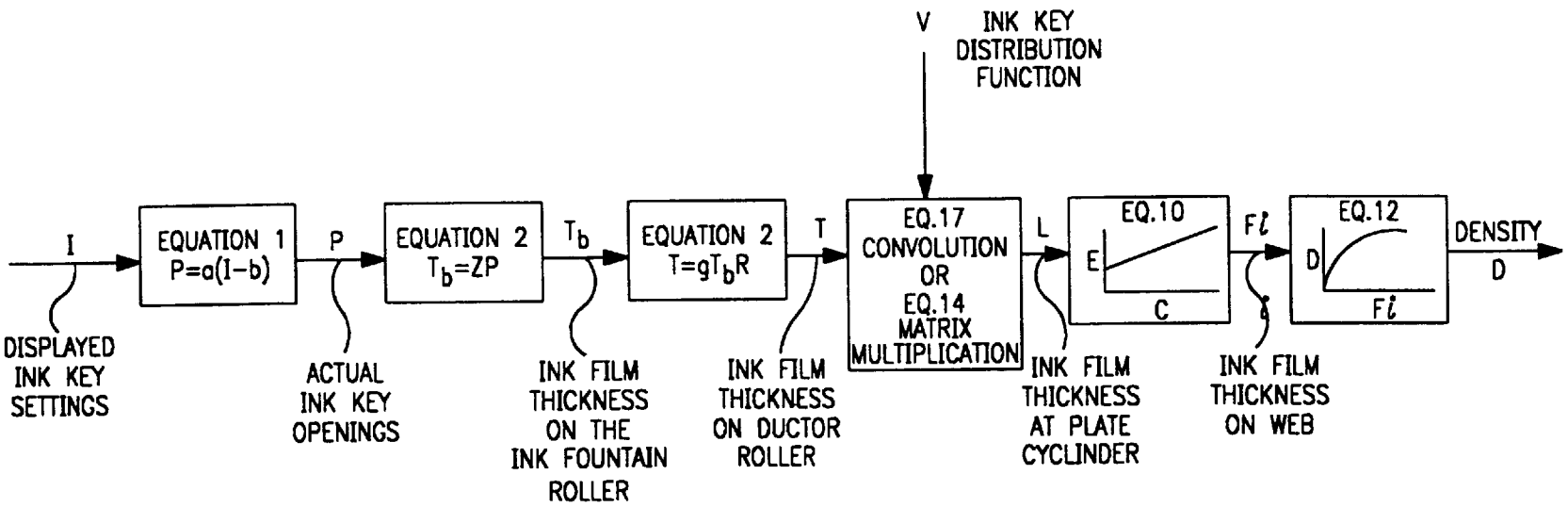
FIG. 25 is a schematic illustration of the inking system model.

FIG. 25 is an illustration of the complete inking system model. Another way to view the relationship between the ink film thickness on the ductor roller and the ink key distribution function is in terms of convolution, rather than the matrix multiplication of Equation 14. In other words, in order to estimate a function L, representative of the amount of ink supplied to the plate cylinder given the ink key openings, a convolution of a function representative of the ink film thickness on the ductor roller, T, with the function representative of the ink key distribution function, V is required:

$$L = V * T \qquad \text{Equation 17}$$

where * represents convolution.

The inking system model represented in FIG. 25 can be used to calculate an expected ink optical density given the displayed ink key settings. In this case, calculations proceed from left to right. The inking system model can also be used to calculate required ink key settings given required densities and plate coverages, c, for each ink key zone, in which case, calculations proceed from right to left in FIG. 25. In order to determine the required ink key openings from data representing zonal plate coverage and required densities requires a deconvolution or matrix multiplication involving the inverted matrix VM, as further described below.

Equation 14 can be rewritten in terms of a matrix multiplication:

$$L = VM\,T \qquad \text{Equation 18}$$

where L is a 24 by 1 element matrix containing values representative of the ink film thickness presented to the printing plate, and T is a 24 by 1 element matrix containing values representative of the ink film thickness on the ductor rollers. (The size is determined by the fact that there are 24 ink keys on the Harris M1000B press). A 24 by 24 element matrix, VM, is formed as the vibrator matrix, where $VM_{ij}$ represents the portion of ink from ink key j which reaches the plate in ink key zone i. If the ink spread is invariant across the ink keys, then matrix VM is a Toeplitz matrix, that is, a matrix in which each row is a shifted version of the row above. Each row contains the elements of the vector V. Matrix VM is illustrated in FIG. 26.

Equation 18 can be rewritten to solve for T:

$$T = VM^{-1}\,L \qquad \text{Equation 19}$$

Figure 27:
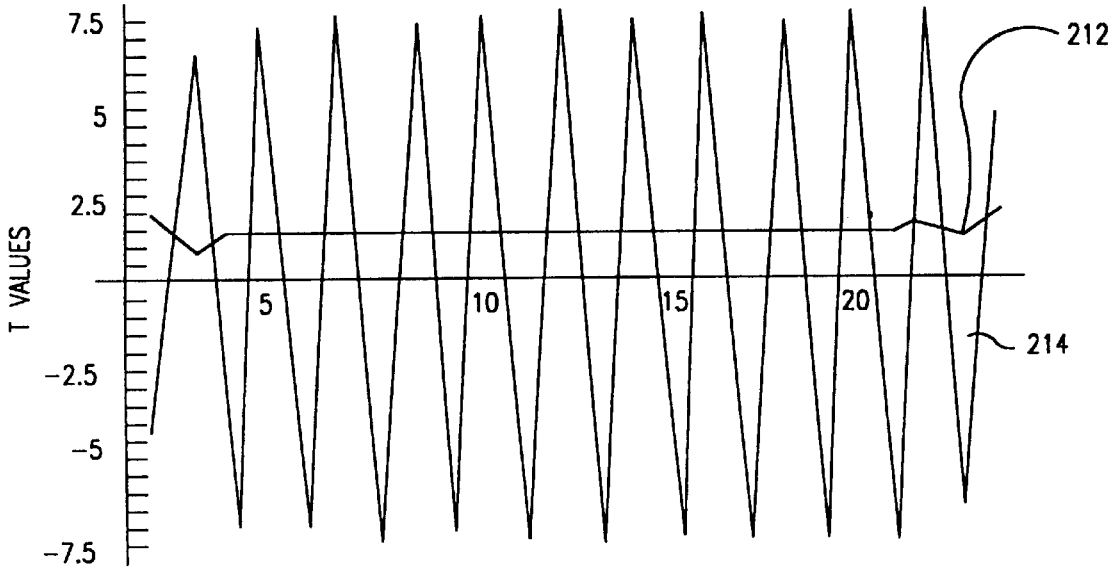
FIG. 27 illustrates the effect of ill-conditioning on matrix VM.

Provided matrix VM is invertible, a solution for ink key openings is obtainable because the ink key openings are linearly related to the ink film thickness on the ductor roller. However, inverted matrix VM may be slightly ill-conditioned. This means that the matrix may amplify noise. FIG. 27 illustrates this effect. Line 212 is a plot of T when L is a vector of all ones. Line 214 is a plot of T when L is a vector with alternating ones and minus ones. FIG. 27 shows that the result obtained by multiplying matrix VM by a vector of all ones is not increased in magnitude, however, multiplying by a vector of alternating ones and minus ones results in a vector which is increased in magnitude by about 7.5. This presents a problem if noise happens to alternate between two values of equal magnitude, in which case the noise level will be magnified by a factor of 7.5.

Because it is expected that the estimate of L will have significant noise, both as process variation and as measurement error, the magnification of the noise could destabilize a color control system.

Singular value decomposition (SVD) is a tool which can be used to lessen the noise amplification of straight matrix inversion. Basically, the SVD approach is to convert the matrix into one which is similar, but not as ill-conditioned as the original. This is accomplished by removing components of the matrix which cause the ill-conditioning, to create a new matrix. The inverse of the new matrix is called the pseudo-inverse.

The common definition of an eigenvalue of a matrix A is those values $\lambda$ for which the determinant of a certain quantity is zero: $\det(A-\lambda I)=0$. The value $\lambda$ is known as the eigenvalue. In general, an N×N matrix will have N eigenvalues. For each eigenvalue, there is an eigenvector x for which the following is true: $Ax=\lambda x$. Multiplication of an eigenvector x by a matrix A will scale that eigenvector by $\lambda$. If noise is in the direction of one of the eigenvectors of $VM^{-1}$, then $\lambda$ predicts how much the noise will be amplified (or reduced).

Figure 28:
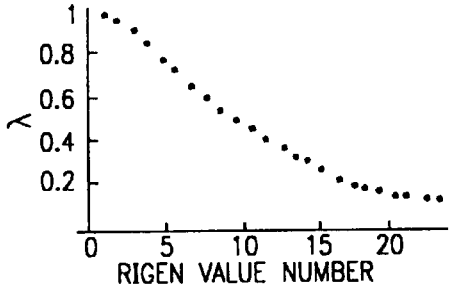
FIG. 28 illustrates the eigenvalues for matrix VM.

Eigenvalue analysis has been performed on the matrix VM. FIG. 28 illustrates the eigenvalues, plotted in descending order. The smallest eigenvalue is 0.134, which has a corresponding eigenvector which looks a lot like line 214 of FIG. 27. The largest eigenvalue is 0.982, which has a corresponding eigenvector like the line 212 in FIG. 27.

The eigenvectors of a matrix span the space. That is, any arbitrary vector y can be expressed as a weighted sum of the eigenvectors, $x_i$. For all vectors y, there exist a set of weights $a_i$, such that:

$$y=\Sigma a_i x_i$$

Therefore, $A\,y=A\,\Sigma\,c_i x_i=\Sigma\,c_i A\,x_i=\Sigma\,c_i \lambda_i x_i$ This illustrates that for an arbitrary vector, multiplying by a matrix will scale the vector by some amount between the smallest eigenvector and the largest eigenvector. Thus, these two values are key to determining how ill-conditioned a matrix is. In other words, in order to condition a matrix, the matrix is decomposed into a product of eigenvectors and eigenvalues, the smallest eigenvalues are eliminated, and the new matrix is formed. The new matrix is the closest approximation to the original matrix which can be formed without the eigenvectors associated with the smallest eigenvalue.

Another approach to solving Equation 17 for T takes advantage of the convolution theorem. The convolution theorem states that convolution in the spatial domain is equivalent to multiplication in the frequency domain. With respect to Equation 17, this means that the product of the Fourier transform of the ink key distribution function, V, and the Fourier transform of the ink key openings is equal to the Fourier transform of the ink film thickness on the plate. Defining v, 1, and t to be the Fourier transforms of V, L, and T respectively, then the deconvolution can be performed according to the following:

$$t=1/v \qquad \text{Equation 20}$$

Many details do not appear in this deceptively simple equation. To actually use Equation 20, one needs to compute the Fourier transforms of L and V. This can be efficiently accomplished by means of a fast Fourier transform (FFT), but for smaller vectors, efficiency is not critical. Then division is performed, point by point, between the two frequency space vectors 1 and v. The result of the division then needs to be converted back to the spatial domain by an inverse Fourier transform.

Figure 29:
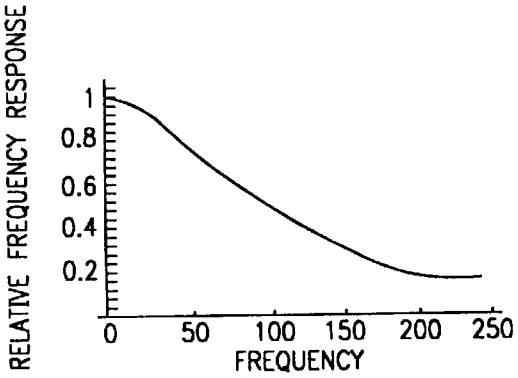
FIG. 29 illustrates the Fourier transform of the ink key distribution function.

FIG. 29 illustrates the Fourier transform of the ink key distribution function. This is the function which is the divisor in frequency space in Equation 20. Note that at very low frequencies, there is no appreciable attenuation. However, at the higher frequencies, when dividing by a value of 0.14 results in a multiplication of about 7.5.

Another technique building off the FFT approach is called Wiener deconvolution, which solves the question of optimality in the presence of noise. With a matrix such as VM, a Wiener deconvolution technique would essentially curb the effects which occur at the higher frequencies.

Combining Equations 1, 2, and 3 results in the following:

$$T_i=g\ z\ a\ R(I_i-b_i)=G\ R(I_i-b_i) \qquad \text{Equation 21}$$

The constants g, z, and a may be individually measured. An easier, alternative means is to merely determine their product, G, as defined in Equation 16. Fortunately, G can be readily attained by empirical measurements. To obtain G, measurements are taken of images on the web at a particular vector of known ink key settings I. Density measurements of the image are taken, and the vector, T, of ink film thicknesses on the ductor roller is calculated by means previously described, i.e., using Equations 12 and 10, and performing a deconvolution. The following equation represents G:

Equation 22:

$$G=\frac{T_i}{(I_i-b_i)R}$$

Equation 22 can be solved for any particular ink key zone i to obtain an estimate of the value of G. Alternatively, an improved estimate may be obtained by computing a weighted average of the calculated estimates of G over some combination of the ink key zones.

Note that once G has been determined, there are still two unknown variables in Equation 21, namely R, the ratchet setting, and $I_i$, the ink key settings. It is possible to solve for an ink key setting vector I for any choice of ratchet setting R. One means for determining vector I is to allow the press operator to select an appropriate ratchet setting based on his or her judgement and the plate coverage.

A more accurate and less labor intensive method for ratchet setting is to automate the process. In theory, any ratchet setting is acceptable. In practice, however, there are constraints on the ratchet setting. Ratchet settings which are too low may require ink key openings which are beyond the physical limits of the ink key. On the other hand, setting the ratchet too high leads to very low ink key openings, and a greater sensitivity of ink film thickness to changes in ink key opening. This reduces the precision in the ink key opening.

The optimal condition is met when the ratchet setting is as low as possible without forcing the ink key openings beyond a certain fraction of the physical limit. This fraction H is necessary to allow room for subsequent adjustment. The value of H depends upon the extent that the model and parameters accurately depict the individual press, the extent that the model and parameters accurately depict the individual press, the extent that the solid ink densities may need to be varied from "ideal densities" in order to satisfy personal tastes, and the extent that the individual press may experience process variation in color. The limit H may take on a value of 0.8.

The setting of the ratchet is accomplished by Equation 23:

$$R=\max_i[T_i/(G(H-b_i))] \qquad \text{Equation 23}$$

The ink key openings $I_i$ for each ink key i are then computed in accordance with the following:

$$I_i=T_i/(G\ R)+B_i \qquad \text{Equation 24}$$

The inking system model described above and illustrated in FIG. 25 is equally applicable to a color control system on an operational press. Color quality is typically monitored on-press by measuring the optical density of a series of color bars printed on the web. The measured density may vary from a desired value for a variety of reasons. For example, both paper grade and paper characteristics have an effect on color quality. Additionally, on web startup, the desired color quality may need to be adjusted somewhat. Other reasons for adjusting color while a press is running include the personal preferences of a print customer who is monitoring the press run.

Figure 30:
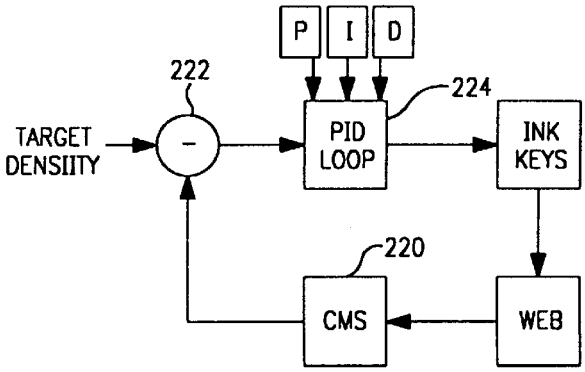
FIG. 30 illustrates a conventional proportional-integral-derivative control loop.

A color control system utilizing a conventional proportional-integral-derivative (PID) control loop is illustrated in FIG. 30. In general terms, measurements of color density are obtained by a color monitoring system (CMS) 220 and are compared to desired values at block 222. The results of the comparison are fed to a PID loop 224, which produces control signals which are fed to the ink keys, and the ink keys are adjusted accordingly. The adjusted ink flow works its way through the ink-roller train and is deposited on the web. Typically, once the images corresponding to the adjusted ink flow on the web have travelled to the point of color density measurement, the control loop is repeated.

The conventional control loop shown in FIG. 30 does not take into account the nonlinear relationship between ink density and ink thickness on the web and thus suffers from a significant nonlinearity. When the ink film thickness is very low, a unit change in ink film thickness will result in a fairly large change in density. At higher densities (as the saturation density is approached), the same change in ink film thickness results in a fairly small change in density. The system gain may be four times as great at extremely low thickness as compared to that at nominal thickness.

Figure 31:
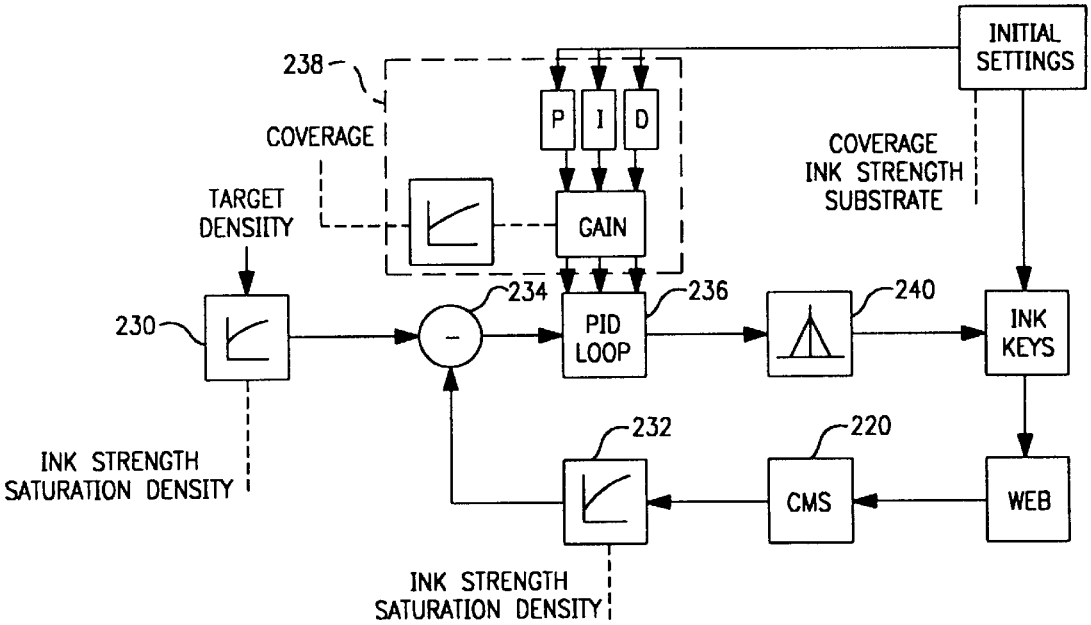
FIG. 31 illustrates a color control loop in accordance with the present invention.

A color control system which accounts for the ink density saturation effect, as well as other effects, is illustrated in FIG. 31. A color monitoring system which accurately measures the optical density of a printed image while the press is running is described in allowed U.S. patent application Ser. No. 08/434,928, now U.S. Pat. No. 5,724,259 invented by John C. Seymour, Jeffrey P. Rappette, Frank N. Vroman, Chia-Lin Chu, Bradly S. Moersfelder, Michael A. Gill and Karl R. Voss. This patent application is hereby incorporated by reference. A video camera is utilized to acquire sequential images in different ink key zones across the web. The video camera is moved laterally across the web in a series of steps to acquire images at different zones at intervals of approximately one second.

In order to account for the effects of ink density saturation, the control loop of FIG. 31 has been converted from a "density control loop" as described in the conventional model to an "ink film thickness control loop". A conversion circuit 230 converts the desired ink density into a desired ink film thickness, and a conversion circuit 232 converts the measured ink density into an ink film thickness value. Conversion circuits 230 and 232 incorporate the relationship of Equation 12.

A comparison is made between the desired and actual ink film thickness values at block 234, and the results are fed to a PID loop 236. The ideal PID loop parameters will depend upon the gain of the system. If the PID parameters are too low, then the control loop will converge slowly. If the parameters are too high, the control loop will overcorrect, and oscillate. Ideally, the PID parameters represent a compromise between these conditions.

The conventional control system does not take into account the relative ink utilization factor which is dependent on plate coverage. An adjustment of an ink key by a predetermined amount in an area of low plate coverage will result in a larger change in ink film thickness on the web (corresponding to a higher change in optical density) as compared to the same ink key adjustment in an area of high plate coverage. To correct for this effect, the gains for the PID loop are set to lower values in areas of lighter coverage by the following equations:

$$P'=(0.46+0.54c)P$$

$$I'=(0.46+0.54c)I$$

$$D'=(0.46+0.54c)D$$

The variables P, I, and D are the "standard" PID parameters corresponding to 100% coverage, and the primed variables are the corresponding corrected variables. These corrections are accomplished by block 238, and take into account Equation 10.

The effects of the vibrator rollers are also included in the color control system of FIG. 31. Mathematically speaking, this is a deconvolution or deblurring problem, in which one seeks to find the ink key settings given an ink key distribution function and a desired ink distribution. In the preferred embodiment of the color control system, the ink density measurements for a respective ink key zones reach the PID loop serially in time rather than all at once.

If the measurements came in all at once, the problem would be one of trying to determine the optimal corrections based on a vector of ink film thickness errors. In this case, however, the vector of density errors is constrained to have all but one of the elements set to zero. As previously described, one method to obtain the ink key settings is by determining the inverse of the ink key distribution function and convolving it with the ink film thickness error vector at block 240. Because the elements of the inking system model are linear, the result of taking the keys one at a time and summing them is the same as taking them on all at once.

It is preferable to take a measurement of one ink key zone, make a correction, take another measurement, make another correction, and so on. This is quicker than waiting until the measurements for all ink key zones are in. It may seem that a potential problem exists in that the second and subsequent measurements are potentially "corrupted" by the fact that the color of the neighboring ink key zone is being adjusted while the density in the second ink key zone is being measured. However, the whole purpose of the color correction is to change the color on only one ink key zone. To the extent that the ink key distribution function correctly models the ink spread, the densities of the neighboring ink key zones will not change.

One complication which may occur is that the control algorithm may call for an ink key setting which is beyond the physical limits of an ink key. For example, the requested ink key setting may be for an opening greater than 100%, or for a setting which is negative. In the simplest implementation, requested ink key openings which are out of range are merely clipped, so that they do not go beyond the extreme values.

In the preferred embodiment, there are separate actions for an ink key being requested to move above 100%, and for an ink key being requested to move to less than zero. In the former case, it may still be possible to attain the proscribed density by increasing the ratchet setting. To accomplish this, the ratchet setting is increased by such an amount as to bring the requested ink key setting within the physical limits.

Since the ratchet setting and the ink key opening are multiplicative, the correction is straightforward. If, for example, the requested ink key opening is 120%, the current ratchet setting must be increased to at least 1.2 times its current value. In this case, the new ink key opening would be set to 100%. Alternatively, it may be preferred to increase the ratchet setting 10% higher in order to allow for some further range of adjustment.

When the ratchet setting is changed, all the ink key openings must be compensated accordingly. If the ratchet setting is increased by multiplying by Q, the ink key openings must all be decreased by dividing by Q.

If an ink key opening is requested to go negative, it may not be possible to attain the target densities. One example is an ink key zone with very low coverage which is adjacent to an ink key zone with very high coverage. The ink spread by the vibrator rollers from the adjacent ink key zone may already be excessive. Clipping the ink key opening (that is, setting it to zero) will avoid requesting the ink key to move beyond its limit, but it may not yield optimal densities.

The suboptimal densities result from the fact that compensation for the effects of the vibrator rollers will require changes in ink key openings for a multiplicity of ink keys. If only a single ink key is clipped, there may not be adequate compensation. As a worst case example, if an above-target density measurement is made in ink key zone i, and that ink key is already at zero, it is not necessary to move the neighboring ink keys to compensate for an ink key change which could not be made.

Another example of a suboptimal condition due to clipping and compensation for the effects of the vibrator rollers is in the aforementioned example of low coverage adjacent to high coverage. Merely clipping may not provide an adequate trade-off between an excessive density in the low coverage ink key zone and an insufficient density in the high coverage ink key zone.

One means for producing ink key changes which improve upon these suboptimal conditions is vector clipping. In the preferred embodiment of this invention, measurements are made in one ink key zone at a time. Due to the compensation for the effects of the vibrator rollers, each density measurement gives rise to a vector of ink key changes, spread out over a multiplicity of ink keys. If any of these ink key changes results in an ink key which is out of range, then the magnitude of each individual ink key change is multiplied by a constant small enough so that no ink key is requested to go out of range. Thus, the entire ink key opening change vector is scaled to keep all the ink key openings within range.

The possibility of running into the boundaries is minimized by using Wiener deconvolution or SVD techniques, as previously explained. Both approaches will decrease the high frequency gain, and thus limit the amount that the ink keys can go negative.

An additional complication for color control is the effect of coverage on the time constant of the press, that is, the amount of time which it takes for a change in inking level to stabilize on a press. Computer model data has been presented of the relationship between the number of impressions required to achieve stabilization, and the plate coverage. This relationship can be described by the following equation, which is a fit of computer model data presented by Chou, Shem and Bain, Lawrence titled "Computer Simulation of Offset Printing: I. Effects of Image Coverage on Feedrate", in the 1996 TAGA Proceedings:

$$t=3.6+19/c \qquad \text{Equation 25}$$

Qualitatively, in areas of lower plate coverage, a change in the ink film thickness requires more time to travel through the ink-roller train 96 because the amount of ink adhering to the various rollers is relatively large compared to the amount of ink leaving the roller onto the web 12. This is equivalent to the electrical model of an RC time constant, with C representing the capacity for ink of the rollers, and lighter coverage representing a larger resistance R in parallel with a fixed $R_b$ representing back-flow into the ink reservoir 38.

The offset term (3.6) in Equation 25 represents the pure delay time for the ink to pass through the ink train and flow onto the paper.

To compensate for the longer settling time-constant of an area of lighter coverage, PID loop 236 uses an integral term which is inversely proportional to the sum of the flow of ink due to coverage in the zone of interest, plus the ink back-flow amount.

In conventional PID loop 224, a change in the PID input will make some change in the PID output essentially instantaneously. However, a change of an ink blade segment 44 can have no effect on the ink coverage to the substrate, until minimally the rollers have rotated sufficiently so that the change in thickness can travel across the various rollers to the substrate. Additional travel delay will generally be caused by the requirement that the printed substrate travels some amount before reaching the CMS.

Other effects which can be taken into account in the inking system model include the effects of ghosting, press speed, different type of paper, the non-linearity of film thickness versus small ink key opening, and physical dot gain. Another factor that could be considered is the dampening system, which has an important effect on the printed image. A proper dampening fluid presetting is also desired in addition to the ink key presetting.

It is understood that the invention is not confined to the particular construction and arrangement of parts herein illustrated and described, but embraces all such modified forms thereof as may come within the scope of the following claims. It will be apparent that many modifications and variations are possible in light of the above teachings. It therefore is to be understood that within the scope of the appending claims, the invention may be practiced other than is specifically described. Alternative embodiments and variations of the method taught in the present specification may suggest themselves to those skilled in the art upon reading of the above description. In particular, the example of a single surface of the paper of a single-web press has been used for clarity, but the invention is equally advantageous on both surfaces of the paper, or on a multi-web press. Many methods are known to accomplish deblurring, and the invention should not be construed to be limited to those disclosed. This disclosure has assumed a matrix VM which is a Toeplitz matrix, and also that the lateral spread of ink is invariant across the ink key zones. Although the FFT and Wiener techniques do require this spatial invariance, the straight matrix inversion technique and the SVD technique are not so constrained. These spatially variant techniques may be applicable where the lateral spread of ink depends on coverage. Although the disclosure teaches the methods of compensation for effects of ink saturation, and compensation for ink back-flow separately, one skilled in the art should recognize that these steps can be combined into a single step for reasons of increased computational efficiency, and that such an embodiment is an equivalent practice of the invention. Also, although the examples disclosed have shown the well-known mechanical ink-key, the invention is equally applicable to other devices which regulate the flow of ink. Furthermore, although the examples are based on the Harris-Heidelberg M1000B print unit, the invention is equally applicable to other ink-train designs.

```
/* inkcover.c */
/* To calculate ink coverage of a plate images */
/* Modification history */
/* 5/30/96 Exclude top and bottom of plate in calculations */
/* 7/17/96 Report both Ink Coverage and Inkkey Presetting */
#include <stdio.h>
#include <stdlib.h>
```

-continued

```
#define NULL 0
#define TRUE (0 == 0)
#define FALSE (!TRUE)
#define N_INKKEY 24
/* Global variables */
char *in_file;
float scale_factor = 1.;
float CylinderCircumference = 22.75; /* inches */
float PlateGap = 0.25; /* inches, approximation */
int end_bars = FALSE;
/* Local function prototypes */
void command_line_parsing(int,char**,
        long*ncol,long*nrow,long*top_blank,long*bottom_blank);
void calc_ink_coverage(char*,long,long,long,long);
/ *********************/
/ *********************/
void print_help(void)
{
    printf("inkcover -- Calculate
        the ink coverage from a input plate image\n");
    printf("Required:\n");
    printf("\t-i=input file name\n");
    printf("\nOptional:\n");
    printf("\t-x=col number (def: 713)\n");
    printf("\t-y=row number (def: 462)\n");
    printf("\t-t=top blank (def: 23 pix)\n");
    printf("\t-b=bottom blank (def: 16 pix)\n");
    printf("\t-s=scale_factor (def: 1)\n");
    printf("\t-e (two end solid bars on plate, def: false)\n");
    exit(0);
}
/ ********************************/
/ ********************************/
void main(int argc, char *argv[])
{
    long ncol=713, nrow=462;
    long top_blank=23, bottom_blank=16;
    long i;
    /* parse command line for locked unit specification */
    command_line_parsing(argc,argv,&ncol,&nrow,&top_blank,
    &bottom_blank);
    printf("%s\n", in_file);
/* Check that the arguments are sensible and consistent */
    if ((in_file == NULL) || (*in_file == '\0'))
    {
        printf("Error - must specify an input file\n");
        print_help();
    }
    calc_ink_coverage(in_file,ncol,nrow,top_blank,bottom_blank);
}
/ ******************************
** Command line parsing
******************************/
void command_line_parsing(int argc,char**argv,
        long*ncol,long*nrow,long*top_blank,long*bottom_blank)
{
    int i;
    char *this_arg;
/* walk through all the arguments */
for (i = 1; i < argc; i++)
{
    /* point us to this argument */
    this_arg = argv [i];
    /* all arguments must start with '-' */
    if (*this_arg != '-')
    {
        printf ("ERROR in argument usage...\n");
        printf ("\t (Arguments must be preceded by a '-'\n\n");
        print_help ();
}
this_arg++;
/* walk through the chars in this argument */
while (*this_arg != '\0')
{
        switch (*this_arg)
        {
            case 'h': print_help ();
                break;
            case 'i': if (*(++this_arg) != '=')
                {
```

-continued

```
                    printf ("ERROR in argument usage...\n");
                    printf ("\t ('-i' must be followed by '='\n");
                    print_help ();
                }
                in_file = ++this_arg;
                while (*this_arg != '\0')
                    this_arg++;
                break;
            case 'x': if (*(++this_arg) != '=')
                {
                    printf ("ERROR in -x argument usage ...\n\n");
                    printf ("\t ('-x' must be followed by '='\n");
                    print_help ();
                }
                *ncol = atoi (++this arg);
                while (*this_arg != '\0')
                    this_arg++;
                break;
            case 'y': if (*(++this_arg) != '\=')
                {
                    printf ("ERROR in -y argument usage...\n\n");
                    printf ("\t ('-y' must be followed by '='\n");
                    print_help ();
                }
                *nrow = atoi (++this arg)"
                while (*this_arg != '\0')
                    this_arg++;
                    break;
            case 't': if (*(++this_arg) != '\=')
                {
                    printf ("ERROR in -t argument usage...\n\n");
                    printf ("\t ('-t' must be followed by '='\n");
                    print_help ();
                }
                *top_blank = atoi (++this_arg);
                while (*this_arg != '\0')
                    this_arg++;
                break;
            case 'b': if (*(++this_arg) != '\=')
                {
                    printf ("ERROR in -b argument usage...\n\n");
                    printf ("\t ('-b' must be followed by '='\n");
                    print_help ();
                }
                *bottom_blank = atoi (++this_arg);
                while (*this_arg != '\0')
                    this_arg++;
                    break;
            case 's': if (*(++this_arg) != '\=')
                {
                    printf ("ERROR in -b argument usage...\n\n");
                    printf ("\t ('-b' must be followed by '='\n");
                    print_help ();
                }
                scale_factor = atof (++this_arg);
                while (*this_arg != '\0')
                    this_arg++;
                break;
            case 'e': end_bars = TRUE;
                        this_arg++;
                        break;
            default: printf ("ERROR - '%c' is not a parameter\n\n",
                *this arg);
                print_help ();
                break;
        } /* end switch */
    } /* end while *this_arg */
} /* end for i */
}
/ ****************************
** Ink coverage calculations
****************************
*void calc_ink_coverage(char*in_file,long ncol,long nrow,
        long top_blank,long bottom_blank)
{
    long i,j,k,m;
    long pixel_per_inkkey[N_INKKEY];
    long previous;
    long plate_nrow;
    long cylinder_nrow;
```

-continued

```
    long left_bar, right_bar;
    unsigned char *buf, *bufptr;
    float *sum, *sumptr;
    float *temp, *tempPtr;
    float *InkSupply,*InkSupplyPtr;
    *float *InkCoverageProfile,*InkCoverageProfilePtr;
    *float sum2[N_INKKEY];
    float inkcover[N_INKKEY];
    float key_open [N_INKKEY];
    float inkkey_width;
    FILE *fp_in;
    plate_nrow = nrow - topblank - bottom_blank;
    printf("Image size: %ld columns, %ld rows, ", *ncol,nrow);
    printf("top_blank: %ld, bottom_ blank: %ld\n",
    top_blank,bottom_blank);
    if ((bufptr=buf=malloc(ncol)) == NULL)
    {
        printf("malloc for buf failed\n");
        exit(0);
}
if ((sumptr=sum=calloc(ncol,sizeof(float))) == NULL)
{
    printf("calloc for sum failed\n");
    exit(0);
}
if ((tempPtr=temp=calloc(ncol,sizeof(float))) == NULL)
{
    printf("calloc for temp failed\n");
    exit (0);
}
if ((InkSupplyPtr=InkSupply
        =calloc(ncol,sizeof(float))) == NULL)
{
    printf("calloc for InkSupply failed\n");
    exit(0);
}
if ((InkCoverageProfilePtr=InkCoverageProfile
        =calloc(ncol,sizeof(float))) == NULL)
{
    printf("calloc for InkCoverageProfile failed\n");
    exit(0);
}
if ((fp_in=fopen(in_file,"rb")) == NULL)
{
    printf("open %s to read failed\n",in_file);
    exit(0);
}
/* Skip the top blank rows of the plate file */
for (i=0;i<top_blank;i++)
    fread(buf,1,ncol,fp_in);
/* Read and sum rows together */
for (i=0;i<plate_nrow;i++)
{
    bufptr=buf;
    sumptr=sum;
    fread(buf,l,ncol,fp_in);
    for(j=0;j<ncol;j++)
    {
        *sptr++ += (float) (*bufptr++);
    }
}
/* Calculate cylinder circumference size by adding plate gap to plate
    circumference size. (300 dpi and 16 time reduction) */
cylinder_nrow = plate_nrow + (long) (PlateGap*300/16+0.5);
/* Calculate Ink Coverage Profile */
sumptr=sum;
InkCoverageProfilePtr = InkCoverageProfile;
for (j=0;j<ncol;j++)
{
*InkCoverageProfilePtr++ = (plate_nrow - *sumptr++ /255.) *100. /
    cylinder_nrow;
}
/* Skip the following if there is no end_bars on edges of plate,
    or can be for comparisons */
if (end_bars)
{
    /* Detect the two solid bars at the edges of the plate */
    InkCoverageProfilePtr = InkCoverageProfile;
    j=0;
    while(*InkCoverageProfilePtr++ >20.) j++;
```

-continued

```
    left_bar = j;
    printf("Exclude columns left to Column %d for the left solid bar\n",
            left_bar);
    InkCoverageProfilePtr = InkCoverageProfile + ncol -1;
    j =ncol;
    while(*InkCoverageProfilePtr-- >20.) j--;
    right_bar = j;
    printf("Exclude columns right to Column %d for the right
            solid bar\n", right_bar);
    /* Fill an array to mask the two solid bars */
    tempPtr = temp;
    for (j=0;j<ncol;j++)
    {
        *tempPtr++ = 1;
    }
    tempPtr = temp;
    for (j=0;j<left_bar;j++)
    {
        *tempPtr++ = 0;
    }
    tempPtr = temp + ncol -1;
    for (j=ncol;j>right_bar;j--)
    {
        tempPtr-- = 0;
    }
    *tempPtr = temp;
    InkCoverageProfilePtr = InkCoverageProfile;
    for (j=0;j<ncol;j++)
    {
        *InkCoverageProfilePtr++ *= *tempPtr++;
    }
} /* end of end_bar */
/* Calculate ink supply needed at ductor roller from ink coverage */
InkSupplyPtr = InkSupply;
InkCoverageProfilePtr = InkCoverageProfile;
for(j=0;j<ncol;j++)
{
    *InkSupplyPtr++ = 46 + 0.54 * *InkCoverageProfilePtr++;
}
/* Calculate average inkkey width and its integer version */
inkkey_width=((float)ncol)/N_INKKEY;
previous=0;
for (k=0;k<24;k++)
{
    pixel_per_inkkey[k]=(long) (inkkey_width*(k+1)+0.5)-previous;
    previous += pixel_per_inkkey[k];
}
/* Calculate ink coverage for each ink key */
InkCoverageProfilePtr = InkCoverageProfile;
for (k=0;k<24;k++)
{
    sum2[k]=0.;
    for (m=0;m<pixel_per_inkkey[k];m++)
    {
        sum2[k] += *InkCoverageProfilePtr++;
    }
}
for (k=0;k<24;k++)
{
    inkcover[k] = sum2[k] / pixel_per_inkkey[k];
}
/* Calculate ink key opening for each ink key */
InkSupplyPtr = InkSupply;
for(k=0;k<24;k++)
{
    sum 2[k]=0.;
    for (m=0;m<pixel_per_inkkey[k];m++)
    {
        sum2[k] += *InkSupplyPtr++;
    }
}
/* Scale the key opening to account for ratchet settings and % transfer
    from fountain roller to ductor roller. Scale factor can be obtained
    by comparing pressman's key settings and the unscaled output key
    settings for the same kind printing. Assumption is no change in
    ratchet settings, water levels, ink key calibration, etc. */
for(k=0;k<24;k++)
{
    key_open[k] = sum2[k] /
        pixel_per_inkkey[k] * scale_factor;
```

-continued

```
}
/* Output the results */
printf("Ink coverages & key opening: from inkkey 1 to 24\n\n");
printf(" 1 2 3 4 5 6 7 8 9 10 11 12 13 14 15 16 17 18 19 20 21 22
    23 24\n");
    for (k=0;k<24;k++)
    {
        printf("%2.0f ",(inkcover[k]= (inkcover[k]<0) ? 0 :
            inkcover[k]));
    }
    printf("\n");
    for(k=0;k<24;k++)
    {
        printf("%2.0f ",key_open[k]);
    }
    printf("\n\n");
    /* Free allocated memory */
    free(buf);
    free(sum);
    free(temp);
    free(InkSupply);
    free(InkCoverageProfile);
}
```

What is claimed is:

1. A method for determining initial settings for a plurality of ink control devices in a printing press wherein the ink control devices control the amount of ink supplied to respective zones of a first roller, wherein ink is transferred from the first roller to a roller train and then to a substrate to print an image, wherein the ink control devices are associated with respective ink key zones on the substrate, and wherein the roller train includes a plate cylinder and a vibrator roller that moves back and forth in a lateral direction with respect to the longitudinal direction of movement of the substrate, the method comprising, determining an ink key distribution function by means of a press test by relating the amount of ink supplied by a single ink control device to the distribution of ink on the substrate in a plurality of affected ink key zones due to the lateral movement of the vibrator roller, determining an ink saturation density function by relating an optical density of ink on the substrate to the ink film thickness on the substrate, and computing an initial setting for each ink control device based on the ink key distribution function given a plate coverage value for a respective ink key zone and a desired optical density of ink on the substrate.

2. The method of claim 1 wherein the step of computing an initial setting for each ink key control device includes determining desired ink film thicknesses on the substrate and relating the desired ink film thicknesses on the substrate to ink film thicknesses on the plate cylinder and performing a deconvolution of the ink key distribution function with the desired ink film thicknesses on the plate cylinder for the respective ink key zones to obtain a desired ink film thickness on the first roller for each respective ink key zone.

3. The method of claim 2 wherein the step of performing a deconvolution includes the use of Fourier transforms.

4. The method of claim 3 wherein the step of performing a deconvolution includes the use of fast Fourier transforms.

5. The method of claim 2 wherein the step of performing a deconvolution includes performing a Wiener deconvolution.

6. The method of claim 1 wherein the step of computing an initial setting for each ink control device includes representing the desired ink film thickness on the plate cylinder for each respective ink key zone as a first array, representing the ink key distribution function as a first matrix, inverting the first matrix to obtain a second matrix, and performing a matrix multiplication of the second matrix with the first array to obtain a desired ink film thickness on the first roller for each respective ink key zone.

7. The method of claim 6 wherein the first matrix is a Toeplitz matrix.

8. The method of claim 6 wherein the first matrix is spatially variant.

9. The method of claim 1 wherein the step of computing an initial setting for each ink control device includes representing the desired ink film thickness on the plate cylinder for each respective ink key zone as a first array, representing the ink key distribution function as a first matrix, generating a second matrix from the first matrix using singular value decomposition, and performing a matrix multiplication of the second matrix with the first array to obtain a desired ink film thickness on the first roller for each respective ink key zone.

10. The method of claim 9 wherein the second matrix is spatially variant.

11. The method of claim 1 further including the step of determining a plate coverage equation which relates a plate coverage value to the corresponding ink film thickness on the plate cylinder needed to obtain a predetermined ink film thickness on the substrate, and wherein the step of computing the initial setting for each ink control device includes the use of the plate coverage equation for determining the desired ink film thickness on the plate cylinder given a desired ink film thickness on the substrate and a plate coverage value for each respective ink key zone.

12. The method of claim 11 wherein the plate coverage equation is a non-proportional plate coverage equation.

13. The method of claim 12 wherein the non-proportional plate coverage equation is a linear plate coverage equation with a nonzero offset.

14. The method of claim 12 wherein the non-proportional plate coverage equation is a model-based plate coverage equation.

15. The method of claim 12 wherein the non-proportional plate coverage equation is an empirically derived plate coverage equation.

16. The method of claim 11 wherein the plate coverage equation is a proportional plate coverage equation.

17. The method of claim 11 wherein the step of computing an initial setting for each ink control device includes computing a desired ink film thickness on the substrate for each respective ink key zone given a desired optical density of ink on the substrate.

18. The method of claim 17 wherein the plate coverage equation is a non-proportional plate coverage equation.

19. The method of claim 18 wherein the non-proportional plate coverage equation is a linear plate coverage equation with a nonzero offset.

20. The method of claim 18 wherein the non-proportional plate coverage equation is a model-based plate coverage equation.

21. The method of claim 18 wherein the non-proportional plate coverage equation is an empirically derived plate coverage equation.

22. The method of claim 17 wherein the plate coverage equation is a proportional plate coverage equation.

23. The method of claim 11 wherein the step of computing an initial setting for each ink control device includes performing a deconvolution of the ink key distribution function with the desired ink film thicknesses on the plate cylinder for the ink key zones to obtain a desired ink film thickness on the first roller for each respective ink key zone.

24. The method of claim 23 wherein the step of performing a deconvolution includes the use of Fourier transforms.

25. The method of claim 23 wherein the step of performing a deconvolution includes performing a Wiener deconvolution.

26. The method of claim 11 wherein the step of computing an initial setting for each ink control device includes representing the desired ink film thickness on the plate cylinder for each respective ink key zone as a first array, representing the ink key distribution function as a first matrix, inverting the first matrix to obtain a second matrix, and performing a matrix multiplication of the second matrix with the first array to obtain a desired ink film thickness on the first roller for each respective ink key zone.

27. The method of claim 26 wherein the second array is a Toeplitz matrix.

28. The method of claim 11 wherein the step of computing an initial setting for each ink control device includes representing the desired ink film thickness on the plate cylinder for each respective ink key zone as a first array, representing the ink key distribution function as a first matrix, generating a second matrix from the first matrix using singular value decomposition, and performing a matrix multiplication of the second matrix with the first array to obtain a desired ink film thickness on the first roller for each respective ink key zone.

29. The method of claim 1 further including the step of determining an ink saturation density function which relates the optical density of ink on the substrate to the ink film thickness on the substrate, and wherein the step of computing an initial setting for each ink control device includes computing a desired ink film thickness on the substrate for each respective ink key zone given a desired optical density of ink on the substrate.

30. The method of claim 29 wherein the step of computing an initial setting for each ink control device includes performing a deconvolution of the ink key distribution function with the desired ink film thicknesses on the plate cylinder for the ink key zones to obtain a desired ink film thickness on the first roller for each respective ink key zone.

31. The method of claim 30 wherein the step of performing a deconvolution includes the use of Fourier transforms.

32. The method of claim 28 wherein the step of computing an initial setting for each ink control device includes representing the desired ink film thickness on the plate cylinder for each respective ink key zone as a first array, representing the ink key distribution function as a first matrix, inverting the first matrix to obtain a second matrix, and performing a matrix multiplication of the second matrix with the first array to obtain a desired ink film thickness on the first roller for each respective ink key zone.

33. The method of claim 1, wherein the press test includes closing all but a single ink control device and measuring the optical densities of neighboring ink key zones on the substrate.

34. A method for determining initial settings for a ratchet and a plurality of ink control devices in a printing press wherein the ratchet and the ink control devices control the amount of ink supplied to respective zones of a first roller, wherein ink is transferred from the first roller to a roller train and then to a substrate to print an image, wherein the ink control devices are associated with respective ink key zones on the substrate, and wherein the roller train includes a plate cylinder and a vibrator roller that moves back and forth in a lateral direction with respect to the longitudinal direction of movement of the substrate, the method comprising, determining an ink key distribution function by relating the amount of ink supplied by a single ink control device to the distribution of ink on the substrate in a plurality of affected ink key zones due to the lateral movement of the vibrator roller by means of a press test, determining an ink saturation density function by relating an optical density of ink on the substrate to the ink film thickness on the substrate, and computing the ratchet setting and an initial setting for each ink control device based on the ink key distribution function given a plate coverage value for a respective ink key zone and a desired optical density of ink on the substrate.

35. The method as recited in claim 34 wherein the ratchet setting is selected to be at a minimum while keeping the ink control device settings within a pre-selected fraction of the physical limit of ink control device movement.

* * * * *